US005572308A

United States Patent [19]

Suda et al.

[11] Patent Number: 5,572,308

[45] Date of Patent: Nov. 5, 1996

[54] IMAGE FORMING APPARATUS WITH CURL FORMING MEANS

[75] Inventors: Masashi Suda, Iruma; Junichi Sata, Kawasaki, both of Japan

[73] Assignee: Canon Kabushiki Kaisha, Tokyo, Japan

[21] Appl. No.: 407,870

[22] Filed: Mar. 21, 1995

[30] Foreign Application Priority Data

| | | | |
|---|---|---|---|
| Mar. 24, 1994 | [JP] | Japan | 6-053794 |
| Mar. 24, 1994 | [JP] | Japan | 6-076304 |
| Mar. 14, 1995 | [JP] | Japan | 7-054018 |

[51] Int. Cl.[6] ..... G03G 21/00

[52] U.S. Cl. ..... 399/401; 162/271; 271/3.03; 399/406

[58] Field of Search ..... 355/319, 318, 355/320, 309, 282, 326 R; 271/291, 188, 209, 3.1; 162/271

[56] References Cited

U.S. PATENT DOCUMENTS

| | | | |
|---|---|---|---|
| 3,290,238 | 11/1975 | Kitajima et al. . | |
| 4,050,691 | 9/1977 | Ito et al. . | |
| 4,627,718 | 12/1986 | Wyer | 162/271 X |
| 4,652,110 | 3/1987 | Sato et al. | 162/271 X |
| 4,953,037 | 8/1990 | Ito et al. . | |
| 5,144,385 | 9/1992 | Tani | 355/309 |
| 5,176,373 | 1/1993 | Namba | 271/3.1 |
| 5,209,465 | 5/1993 | Sayama et al. . | |
| 5,270,778 | 12/1993 | Wyer | 355/311 |
| 5,392,106 | 2/1995 | Bigenwald et al. | 355/309 |
| 5,396,321 | 3/1995 | McFarland et al. | 355/313 |
| 5,414,503 | 5/1995 | Siegel et al. | 355/309 |
| 5,434,029 | 7/1995 | Moser | 430/97 |

OTHER PUBLICATIONS

"Patent Abstracts of Japan", vol. 18, No. 310 (M1620), For 06–64782 published Mar. 8, 1994.

"Patent Abstracts of Japan" vol. 11, No. 166 (M593), for 61–295965 published Dec. 26, 1986.

"Patent Abstracts of Japan", vol. 11, No. 149 (M588), for 61–282254 published Dec. 12, 1986.

*Primary Examiner*—R. L. Moses

*Attorney, Agent, or Firm*—Fitzpatrick, Cella, Harper & Scinto

[57] ABSTRACT

The present invention relates to an image forming apparatus in which a sheet is carried by a sheet carrier to form an image, and the sheet, on which the image has been formed, is again supplied to the sheet carrier by a re-supply unit to again form an image on the sheet.

An object of the present invention is to improve a sheet conveying apparatus to enable a sheet again supplied by a re-supply unit to be easily carried by a sheet carrier.

To achieve the object, the image forming apparatus according to the present invention has a curl forming unit for curling a sheet, which is being again supplied by the re-supply unit, in a direction in which the sheet can easily be carried by the sheet carrier.

24 Claims, 21 Drawing Sheets

IMAGE FORMING APPARATUS WITH CURL FORMING MEANS

BACKGROUND OF THE INVENTION

1. Field of the Invention

The present invention relates to an image forming apparatus, such as a copying machine, a laser beam printer or a facsimile machine.

2. Related Background Art

Hitherto, since an image forming apparatus, such as a copying machine, that is able to form images on two sides of sheets, causes the sheet to straight pass through a transferring portion thereof and prevents excess change in the quantity of formed curl (hereinafter called "curl") depending upon the quantity of toner, the image forming apparatus of the foregoing type has been used relatively early. The schematic structure of the foregoing two-side copying machine will now be described. A sheet supplied from a sheet cassette or the like is carried by a transferring drum so that an image is formed and fixed on the first side of the sheet. Then, each sheet is reversed to cause the side of the sheet to face upwards and the sheets are stacked on an intermediate tray, and then the sheets are again sequentially supplied so that images are formed on the second sides of the sheets.

Among the above-mentioned conventional two-side copying machines, a color copying machine, in particular, an apparatus of a type, in which a sheet is carried by a transferring drum and thus image transference is performed plural times, however involves reduction in water in the sheet, on which an image has been fixed after the first image transference, causing the sheet to be hardened. If the quantity of toner is large, the sheet will easily be curled, causing the sheet conveyance operation to be made unstable at the time of the second image forming operation. Thus, the reliability in stacking the sheets on the intermediate tray is unsatisfactory and the sheet cannot sometimes stably be wound around the transferring drum.

That is, as shown in FIG. 21, if sheets 302, to each of which an image for the first side has been fixed, and which have been reversed and conveyed, are curled downwards, following sheets 302 conveyed in a direction indicated by an arrow shown in FIG. 21 are undesirably introduced into the stacked sheets 302. As a result, the order of pages will be disordered and the sheets cannot be stacked as desired, thus causing paper jamming to take place. To prevent this, it might be considered feasible to employ a method in which the sheets 302 are curled upwards. However, undesirable downward curl is formed depending upon the quantity of toner and thus a satisfactory preventive effect has not been obtained. In a case where the sheets 302 are curled upwards, the sheets 302 cannot be easily wound around the transferring drum because the direction of the curl prevents the sheets 302 from being easily wound around the transferring drum when the sheets 302 are again supplied from the intermediate tray 301.

As a result, the sheets cannot smoothly be conveyed when a predetermined number of sheets are stacked in a sheet staking portion. An apparatus of a type, in which sheets are again supplied to the image forming portion after the sheets have been stacked, confronts a problem in that warp of the sheets causes a problem in conveying the sheets and involves a defective image quality, such as incomplete image transference.

Since an ordinary sheet carrier (the transferring drum) is formed into a cylindrical shape, sheets can stably be wound if the sheets are previously curled in the direction of the circumference of the cylindrical shape. In a case where the sheets are electrostatically adsorbed around the transferring drum, the previous curling of the sheets is significantly effective. If only the leading portion of the sheet is previously curled, the sheets can stably be carried.

Since no water reduction takes place and no toner adheres to the sheet when images are formed on the first sides of the sheets, thin sheets can be carried stably even if the sheets are curled slightly or the sheets are not curled because the thin sheets (100 g/m$^2$ or less) have weak stiffness. In a case of thick sheets, the thick sheets can be carried stably or electrostatically adsorbed by previously curling the sheets. Thick sheets can be usually fed from a manual paper feeding tray and are allowed to pass through curl-forming rollers so as to be curled. Thick sheets can be curled by the rollers more strongly than thin sheets. The reason for this is that deflection of fibers of the paper occurring when the thick sheet passes between the curl-forming rollers cannot easily be restored as compared with thin sheets. Thin sheets are smoothly guided in a direction of curling and therefore the quantity of the curl is reduced. Since thin sheets are stably carried or electrostatically adsorbed even if the quantity of curl is small or no curl is formed, the foregoing curl forming characteristic realized by using the curl-forming rollers is satisfactory. Since even thin sheets have stiffness at the second transferring operation and the sheets are upwardly curled when the sheets have been stacked on the intermediate stacking means as shown in FIG. 22 in a case where an image is formed on each of the first side of the sheets by using toner in a small quantity of adhesion. Therefore, it is advantageous to prevent jamming at the time of stacking the sheets. However, it is disadvantageous to carry the sheet or to electrostatically adsorb the sheet to the transferring drum at the second transference operation. Therefore, even if the sheets are allowed to pass through an adequate curl-forming means at the time of the first transference operation, the sheets cannot be carried by the transferring drum or electrically adsorbed.

SUMMARY OF THE INVENTION

An object of the present invention is to provide an image forming apparatus capable of overcoming the problems experienced with the conventional apparatus, enabling sheets to be carried stably by a sheet carrying means thereof, causing the sheets to be stacked stably on an intermediate sheet stacking means thereof, and capable of stably conveying the sheets.

The present invention is found to overcome the foregoing problems experienced with the conventional apparatuses and an object of the same is to provide an image forming apparatus capable of preventing a defect in conveying a sheet again supplied from a sheet stacking portion thereof and a defective image on the sheet occurring due to warp.

According to one aspect of the present invention, there is provided an image forming apparatus in which sheets supplied from sheet accommodating means are carried by a sheet carrier to form and fix images on the first sides of the sheets and then the sheets are reversed to be stacked in intermediate stacking means, and the sheets are again supplied so that images are formed on the second sides of the sheets, the image forming apparatus comprising: first curl forming means disposed between image fixing means for fixing an image formed on the sheet and reversing means for reversing and conveying the sheet, the first curl forming means curling the sheet prior to forming an image for the second side of the sheet in a direction in which the sheet can easily be wound around the sheet carrier; and pressing means for pressing the sheet at the time of discharging and stacking the sheets on the intermediate stacking means, the pressing means pressing the sheet in a direction in which curl of the sheet formed by the first curl forming means is corrected.

Since the first curl forming means is disposed between the image fixing means for fixing an image on a sheet and the reversing means for reversing and conveying the sheet, the sheet can be curled prior to forming an image for the second side of the sheet in the direction in which the sheet can easily be carried by the sheet carrier.

By providing the pressing means for pressing the sheet in a direction in which the curl formed by the first curl forming means is corrected, the sheets discharged and stacked onto the intermediate stacking means can stably be stacked.

In order to achieve the foregoing object, according to another aspect of the present invention, there is provided an image forming apparatus having sheet stacking means on which sheets, on which images have been formed, are temporarily stacked to again supply the sheets in the sheet stacking means so as to form images on the sheets, the image forming apparatus comprising: a pressing member for pressing at least the rear ends of the sheets in the sheet stacking means.

It is preferable that a plurality of the pressing members are disposed on the sheet stacking means.

It is more desirable that the pressing member is made of an elastic material.

It is preferable that the temperature adjustment means be disposed on the bottom surface of the sheet stacking means.

In the image forming apparatus having the foregoing structure, the pressing member for pressing at least the rear ends of the sheets is provided for the sheet stacking means so that warp of the sheet can be prevented.

By disposing a plurality of the pressing members on the sheet stacking means, sheets of a plurality of sizes can selectively be used.

Since the pressing member is made of an elastic material, the force for pressing the sheet can be adjusted.

The temperature adjustment means provided for the sheet stacking means heats the sheet to a desired level.

By disposing the temperature adjustment means on the bottom surface of the sheet stacking means, the sheet can easily be brought into contact with the temperature adjustment means.

Other and further objects, features and advantages of the invention will be evident from the following detailed description of the preferred embodiments in conjunction with the attached drawings.

DETAILED DESCRIPTION OF THE PREFERRED EMBODIMENT

First Embodiment

Figure 1:
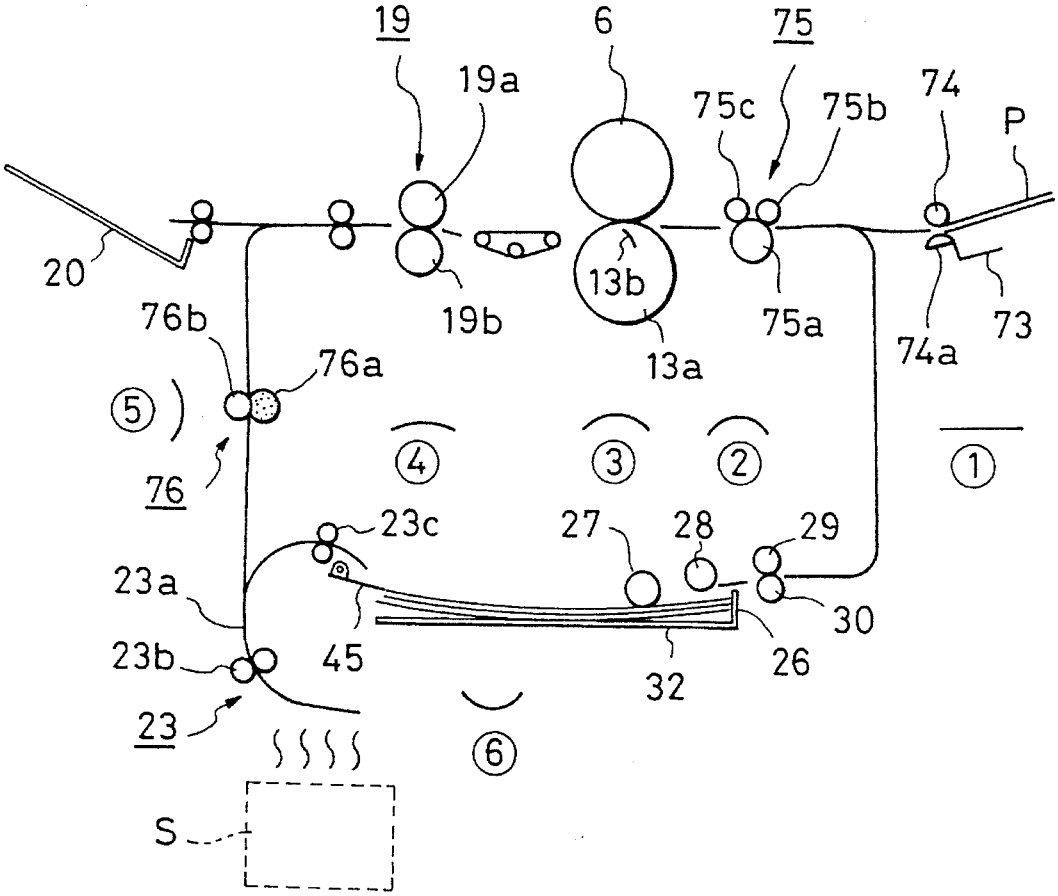
FIG. 1 is a schematic view of a color copying machine.
Figure 3:
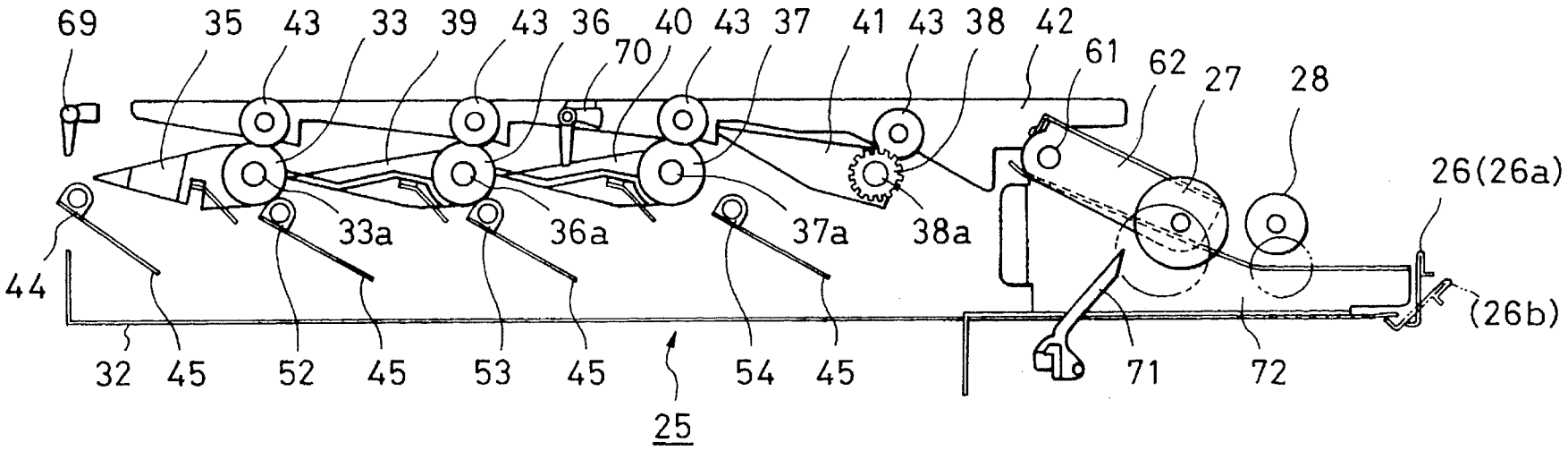
FIG. 3 is a cross sectional view of an intermediate tray.
Figure 4:
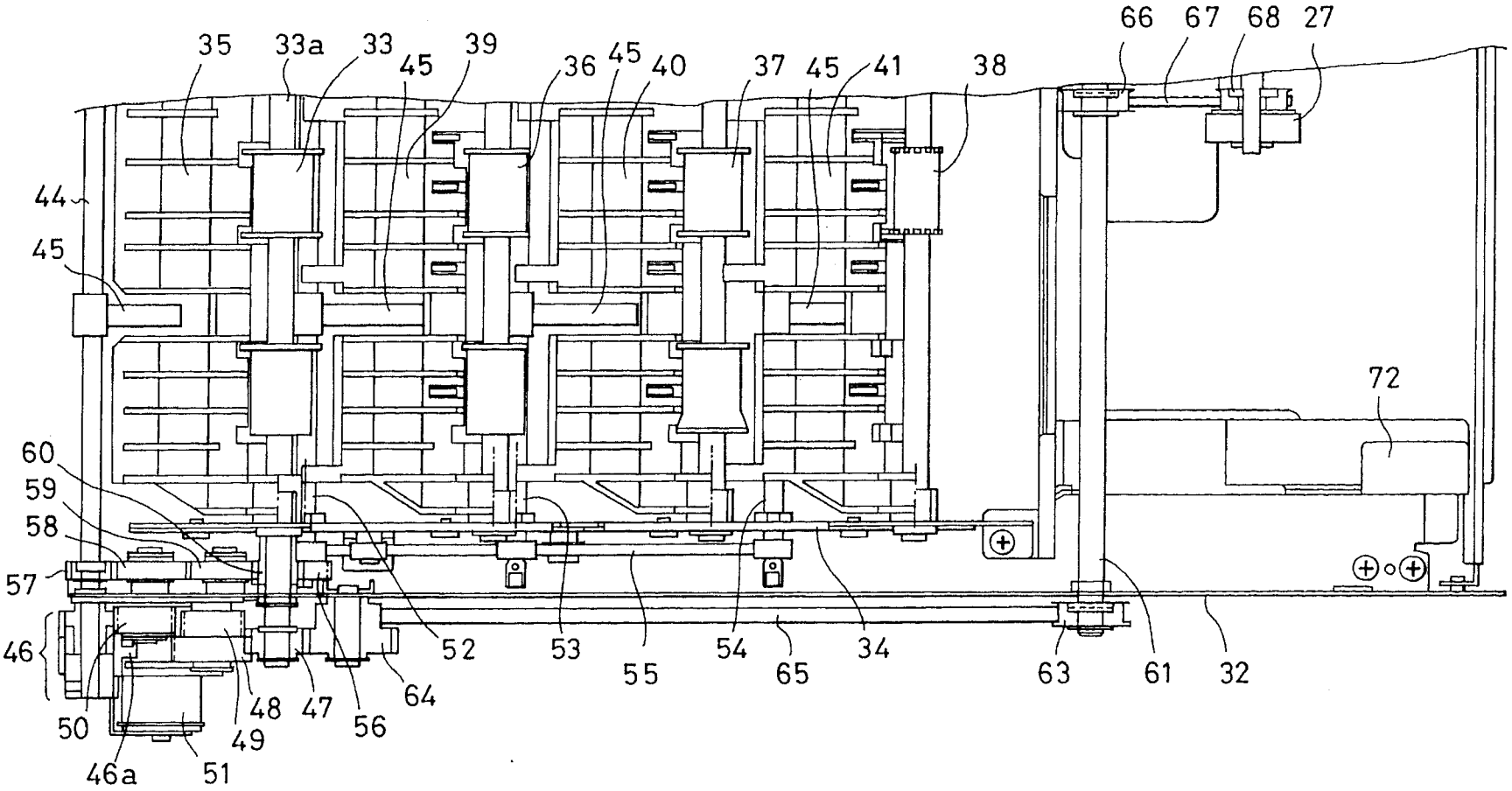
FIG. 4 is a plan view of the intermediate tray.

A first embodiment of an image forming apparatus according to the present invention will now be described with reference to the drawings. In this embodiment, a color copying machine capable of recording images on the two sides of sheets is employed as the image forming apparatus. FIG. 1 is a schematic view of the color copying machine, FIG. 2 is a diagram showing the schematic structure of the color copying machine, FIG. 3 is a cross sectional view of an intermediate tray, and FIG. 4 is a plan view of the intermediate tray.

Initially, the schematic structure of the color copying machine will now be described with reference to FIG. 2. The color copying machine comprises an image forming means consisting of a digital color image reader portion in the upper portion thereof and a digital color image printer portion in the lower portion thereof. In the digital color image reader portion, an original document 1 is placed on an original-document retaining glass 2 and the original document is exposed to light and scanned by an exposing lamp 3. Thus, reflected optical image E from the original document 1 is, by a lens 4, converged onto a full-color sensor 5 so that a color-decomposed image signal is obtained. The color-decomposed image signal is supplied to an amplifying circuit (not shown), and then it is processed by a video processing unit (not shown) and transferred to the digital color image printer portion.

Figure 2:
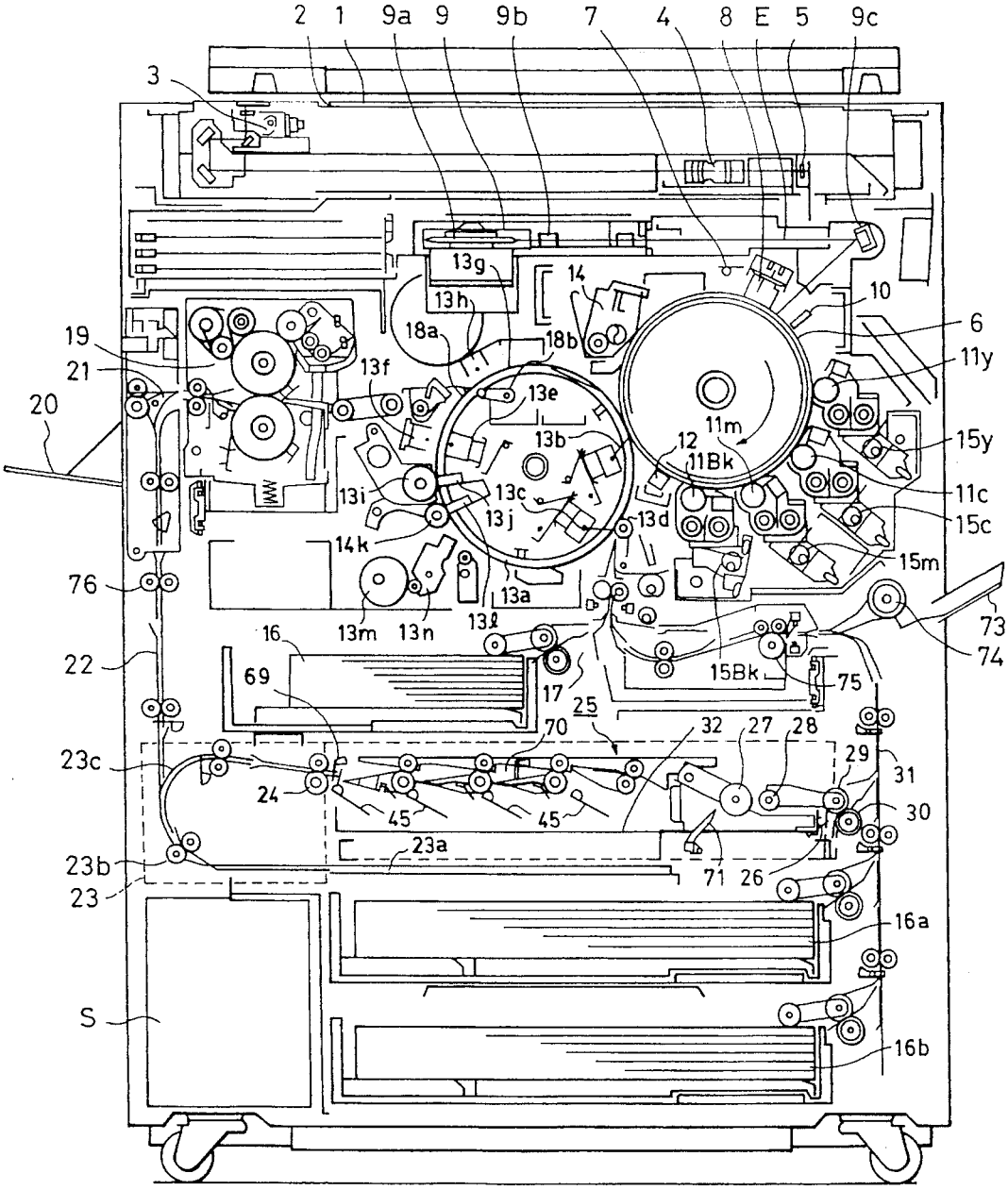
FIG. 2 is a diagram showing the schematic structure of the color copying machine.

In the digital color image printer portion, a photosensitive drum 6 serving as an image carrier is rotatively supported in a direction indicated by an arrow shown in FIG. 2. Around the photosensitive drum 6, the following units are disposed: a previously exposing lamp 7, a primary charger 8, a laser exposing optical system 9, a potential sensor 10, developing units 11*y*, 11*c*, 11*m* and 11Bk for the corresponding colors, a means 12 for detecting the quantity of light on the photosensitive drum 6, a transferring unit 13 and a cleaning unit 14.

In the laser exposing optical system 9, an image signal from the digital color image reader portion is converted into an optical signal in a laser output portion. The converted laser beam is reflected by a polygonal mirror 9*a*, and the laser beam is allowed to pass through a lens 9*b* and a mirror 9*c* so that the laser beam is projected onto the outer surface of the photosensitive drum 6. When an image is formed, the photosensitive drum 6, from which electricity has been removed by the previously exposing lamp 7, is rotated in the direction indicated by the arrow shown in FIG. 2 to uniformly charge the photosensitive drum 6 by the primary charger 8. As a result, the optical image E is irradiated for each decomposed color so that a latent image is formed.

Then, predetermined developing units are operated to develop the latent image on the photosensitive drum 6 so that a toner image containing resin as a basic material thereof is formed on the photosensitive drum 6. The developing units 11*y*, 11*c*, 11*m* and 11Bk for the decomposed colors are caused to selectively approach the photosensitive drum 6 due to the operations of eccentric cams 15*y*, 15*c*, 15*m* and 15Bk.

The toner image on the photosensitive drum 6 is transferred onto a sheet P supplied from a sheet cassette 16 through a sheet conveying system 17 in such a manner that the sheet P is carried to a position to face the photosensitive drum 6 by a transferring drum 13*a* of a transferring unit 13 and voltage of inverse polarity to that of the toner is applied by a transfer charger 13*b*. The sheet cassette 16 accommodates the sheets P having a relatively small size (for example, B5 size or A4 size) and comprises sheet cassettes 16*a* and 16*b* for accommodating sheets P having relatively large size (for example, B4 and A3 sizes). The transferring unit 13 comprises the transferring drum 13*a*, the transferring charger 13*b*, an adsorption charger 13*c* for electrostatically adsorbing the sheet P to the transferring drum 13*a*, an adsorption roller 13*d* facing the adsorption charger 13*c*, an internal charger 13*e* and an external charger 13*f*. A dielectric carrier sheet 13*g* in the form of a cylinder is applied around the outer surface of the transferring drum 13*a* which is rotatively supported. The carrier sheet 13*g* is made of a dielectric sheet made of, for example, a polycarbonate film.

To prevent adhesion of flying toner to the surface of the carrier sheet 13*g* of the transferring drum 13*a* and adhesion of oil to the sheet P, cleaning is performed by a backup brush 13*j* facing a fur brush 13*i*, an oil removing roller 13*k* and a backup brush 131 facing the oil removing roller 13*k* through the carrier sheet 13*g*. The cleaning operation is performed before or after an image is formed. If paper jamming takes place, cleaning is performed at any time.

In this embodiment, an eccentric cam 13*m* is operated at a predetermined timing so that a cam follower 13*n* integrated with the transferring drum 13*a* is operated. As a result, the gap between the carrier sheet 13*g* and the photosensitive drum 6 can be set arbitrarily. At the time of standby for forming an image or if supply of electric power is turned off, the distance from the transferring drum 13*a* to the photosensitive drum 6 is lengthened.

As the transferring drum 13*a* of the transferring unit 13 is rotated, the toner image on the photosensitive drum 6 is transferred onto the sheet P held on the carrier sheet 13*g* due to the operation of the transferring charger 13*b*. Thus, color images of desired number of colors are transferred onto the sheet P adsorbed and conveyed by the carrier sheet 13*g* so that a full color image is formed.

In a case where a full color image is formed, toner images of four colors are transferred, and then the sheet P is separated from the transferring drum 13*a* by a separating claw 18*a*, a separating and pushing roller 18*b* and a separation charger 13*h*. The sheet P is then discharged into a discharge tray 20 disposed outside the apparatus through a heat-fixing roller unit 19 serving as an image fixing means. Toner left on the photosensitive drum 6 after the image has been transferred is removed by the cleaning unit 14 and made standby for the process for forming the next image.

The two-side image forming process will now be described. A conveyance-path switching guide 21 disposed downstream from the heat-fixing roller unit 19 is operated so that the sheet conveying path is switched to a vertical path 22. The switching leads to a fact that the sheet P is introduced into the vertical path 22 and introduced into a reversing unit 23 serving as a reversing means so that the sheet P is guided by a reversing path 23*a*. When the rear end of the sheet P has passed through the branch portion, reversing rollers 23*b* are rotated inversely so that the sheet P is conveyed to the side path 23*c*. Then, a flapper corresponding to the sheet size to be described later is rotated so that the sheet P, which is being conveyed along the side path 23*c*, is discharged to be stacked on an intermediate tray 25 by a reverse discharge roller 24 in such a manner that the upper surfaces of the sheets P face upwards.

A gate 26 disposed at the front end of the intermediate tray 25 is closed when the sheets P are stacked. Whenever one sheet P is stacked, a sweeping roller 27 is rotated so that the leading portion of the sheet P is abutted against the gate 26 and thus the leading portions of the sheets P are aligned. By repeating the foregoing operation for a predetermined number of sheets P, the stacking operation is completed.

When images are formed on the second sides of the sheets P, the gate 26 disposed at the front end of the intermediate tray 25 is opened and a pickup roller 28 applies pressure to the uppermost one of the stacked sheets P and the pickup roller 28 rotates. Thus, the sheets P are sequentially fed. A pair of retard rollers 29 and 30 separates and conveys only the uppermost sheet P so that the sheet P is conveyed to a paper supplying path 31 in the downstream. Then, images for the second sides of the sheets P are formed similarly to the process for forming images for the first sides of the sheets P. The conveyance-path switching guide 21 is operated so that the conveyance path is switched to be connected to the discharge tray 20. The sheets P, on which images have been fixed on the second sides thereof, are sequentially discharged onto the discharge tray 20 in such a manner that the second sides of the sheets P face upwards. The foregoing operation is repeated until no sheet is present on the stacking tray 26 of the intermediate tray 25.

The structure of the intermediate tray 25 will now be described in detail with reference to FIGS. 3 and 4. Referring to FIG. 4, the intermediate tray 25 serving as an intermediate stacking means has a sheet stacking portion 32 formed into a box-shape for accommodating the sheets P. The sheet stacking portion 32 has side plates on which first conveying rollers 33 are supported rotatively. The first conveying roller 33 has a roller shaft 33*a* to which a conveyance support plate 34 is rotatively connected through a bearing. As shown in FIG. 3, a first flapper 35 is movably supported by the roller shaft 33*a* of the first conveying roller 33 through a bearing. Second, third and fourth conveying rollers 36, 37 and 38 are respectively and rotatively supported by the conveyance support plate 34 through bearings. Furthermore, second, third and fourth flappers 39, 40 and 41 are respectively and movably supported by roller shafts 36*a*, 37*a* and 38*a* of the second, third and fourth conveying rollers 36, 37 and 38.

A belt is used to connect pulleys secured to the corresponding roller shafts 33*a*, 36*a*, 37*a* and 38*a* in a region from the first conveying roller 33 to the fourth conveying roller 38. The pulleys transmit rotational force of a main power source (not shown) of the body of the apparatus to the conveying rollers through a coupling secured to the roller shaft 33*a* of the first conveying roller 33 so that the conveying rollers are rotated in the same direction. Conveying rollers 43 rotatively supported by a conveying guide 42 shown in FIG. 3 respectively press the first to fourth conveying rollers 33, 36, 37 and 38 so that the sheets P conveyed from the reversing unit 23 are sequentially conveyed downstream from the first conveying roller 33.

The first to fourth flappers 35, 39, 40 and 41 are respectively and individually turned on/off by drive means, such as electromagnetic solenoids, so as to selectively move the flappers in accordance with the sheet size to determine the port through which the sheets P are discharged.

A first roller shaft 44 is, through a bearing, rotatively supported by the side plate of the sheet stacking portion 32, the first roller shaft 44 being disposed adjacent to the reverse discharge roller 24 of the reversing unit 23. An elastic sheet 45 serving as a pressing means that has a predetermined length and a predetermined width is secured to the first roller shaft 44. The elastic sheet 45 is made of a resin film, preferably a polyester film to realize satisfactory durability. A spring clutch 46 having a control ring 46*a* is, as shown in FIG. 4, attached to an end of the first roller shaft 44. The rotational force is transmitted from a gear 47 secured to an end of the roller shaft 33*a* of the first conveying roller 33 to the foregoing spring clutch 46 through idler gears 48, 49 and 50. An electromagnetic solenoid 51 disposed adjacent to the spring clutch 46 controls the operation of the spring clutch 46 so that the elastic sheet 45 is enabled to perform an intermittent operation such that the elastic sheet 45 rotates once from a position making a predetermined angle within a predetermined time and returns to the original position.

Second, third and fourth roller shafts 52, 53 and 54 are, through bearings, rotatively supported adjacent to the second, third and fourth conveying rollers 33, 36, 37 supported by the conveyance support plate 34. Similarly to the first roller shaft 44, elastic sheets 45 are respectively secured to the second, third and fourth roller shafts 52, 53 and 54. A belt 55 is, as shown in FIG. 4, arranged between pulleys respectively secured to the ends of the roller shafts 52, 53 and 54. The rotational force is, through idler gears 58, 59 and 60, transmitted to a gear 56 secured to an end of the second roller shaft 52 and a gear 57 secured to the first roller shaft 44. Thus, the elastic sheets 45 are respectively rotated once from positions each making a predetermined angle and returned to the original positions in synchronization with the one intermittent rotation of the first roller shaft 44. The elastic sheets 45 attached to the first to fourth roller shafts 44, 52, 53 and 54 press the sheets P stacked in the sheet stacking portion 32 in a direction in which curled sheets P are flattened.

A drive shaft 61 for operating the sweeping roller 27 disposed downstream from the fourth conveying roller 38 in a direction, in which the sheets P are conveyed, is, through a bearing, rotatively supported by the sheet stacking portion 32 as shown in FIG. 3. The sweeping roller 27 is rotatively supported by a rotative plate 62 rotatively attached to the central portion of the drive shaft 62. As shown in FIG. 4, a pulley 63 secured to an end (in the lower portion in FIG. 4) of the drive shaft 61 is, through a belt 65, connected to a gear pulley 64 that engages to the gear 47 secured to the roller shaft 33*a* of the first conveying roller 33. The rotational force is transmitted from the drive shaft 61 to the sweeping roller 27 through a pulley 66 provided for another end (in the upper portion in FIG. 4) of the drive shaft 61, a belt 67 and a pulley 68.

The rotative plate 62 rotatively supporting the sweeping roller 27 is pulled upwards by a spring member (not shown). The rotative plate 62 is connected to a drive means, such as an electromagnetic solenoid (not shown). Thus, the sweeping roller 27 is brought into contact with/separated from the sheet P for a predetermined time when the drive means is turned on/off. When the drive means is turned on, the sweeping roller 27 is moved downward due to the dead weight thereof as shown in FIG. 3 and, therefore, brought into contact with the sheet P. As the sheets P are stacked in the sheet stacking portion 32, the sweeping roller 27 is moved upwards. The gate 26 is rotatively supported by the sheet stacking portion 32. When the sheets P are stacked in the sheet stacking portion 32, the gate 26 is rotated to a closing position 26*a* by a drive means (not shown). When the sheet P is again fed after stacking has been completed, the gate 26 is rotated to an opening position 26*b* by the drive means.

A pickup roller 28 that is enabled to come in contact with/separated from the sheet P by the operation of the body of the apparatus is disposed on a sheet conveyance path between the sweeping roller 27 and the gate 26. After sheets P have been stacked, the pickup roller 28 comes in contact with the uppermost one of the sheets P to sequentially supply the sheets P in the downstream direction. As shown in FIGS. 2 and 3, detection means 69, 70 and 71 comprising phototransistors for detecting the sheets P are respectively disposed downstream from the reverse discharge roller 24 of the reversing unit 23, on the sheet conveyance path from the second conveying roller 36 to the third conveying roller 37 and upstream from the sweeping roller 27.

As shown in FIG. 4, side regulating plates 72 are disposed to face the two widthwise ends of the sheets P near the front end (downstream in the direction in which the sheets P are conveyed) of the sheet stacking portion 32 so as to regulate and align the two widthwise ends of the sheets P stacked in the sheet stacking portion 72. The side regulating plates 72 repeatedly come closer (regulate the two widthwise ends) and move away (standby state) from each other to align the sheets P.

The characteristic structure of the color copying machine will now be described with reference to FIGS. 1 and 2. The operation of the sheet feeding unit is considered into two cases in which sheets P are fed from a manual feeding tray 73 by a feeding roller 74 and in which the sheets P are fed from sheet cassettes 16*a* or 16*b* disposed in the lower portion of the body of the apparatus.

A curl forming roller 75 serving as a second curl forming means is disposed adjacent to a junction of the sheet conveyance path connected from the manual feeding tray 73 or the sheet cassette 16*a* or 16*b*. The curl forming roller 75 consists of rollers 75*a*, 75*b* and 75*c* disposed vertically and having different diameters. By respectively pressing the elastic rollers 75*b* and 75*c* each having a small diameter against the lower roller 75*a* having a large diameter, the sheet P is wound around the lower roller 75*a* so that the sheet P is conveyed. As a result, the sheet P is curled upwards prior to forming an image on the first side of the sheet P. Thus, the sheet P can easily be wound around the transferring drum 13*a* and the sheet P can easily be carried. The lower roller 75*a* and the elastic roller 75*b* as well as serve as a resist roller pair with respect to the sheet P, that is, act to maintain parallelness and timing.

In the vertical path 22 between the heat-fixing roller unit 19 and the reversing unit 23, a curl forming roller pair 76 serving as a first curl forming means is disposed. The curl forming roller pair 76 curls the sheet P in a direction, in which the sheet P can be easily carried by the transferring drum 13*a* (in a direction in which the sheet P is curled to the right) prior to forming an image on the second side of the sheet P. The curl forming roller pair 76 is provided with a sponge roller 76 (made of urethane foam) having a large diameter and a hard roller (for example, a metal roller or a metal roller coated with resin) 76*b* having a small diameter to press the sponge roller 76*a*. The sponge roller 76*a* is deformed so that the sheet P is conveyed while being wound around the hard roller 76*b*. Therefore, a rightward curl is formed. Since the direction of the formed curl opposes the direction of curl formed after an image has been fixed, the sheet P passed through the curl forming roller 76 can stably be conveyed.

The flow of the sheet P and the state of curl of the sheet P when images are formed on the two sides of the sheet P in the thus-constituted color copying machine will now be described with reference to FIG. 1. Referring to FIG. 1, the sheets P supplied onto the manual feeding tray 73 are separated and conveyed by the feeding roller 74 and the paper feeding pad 74*a* so that only the uppermost sheet P is fed. The sheet P is supplied in a flat state as indicated in (1).

Then, diagonal movement of the sheet P is, by the curl forming roller 75, corrected and the sheet P is curled upwards as indicated in (2) when the sheet P passes through the curl forming roller 75.

Next, a toner image is transferred to the sheet P when the sheet P passes between the photosensitive drum 6 and the transferring drum 13*a*. In a case where a color image is obtained, the sheet P is wound around the transferring drum 13*a* and the sheet P is electrostatically carried by the transferring drum 13*a* to perform the transferring operation plural times (usually four times). Since the sheet P is, at this time, previously curled by the curl forming roller 75 so as to be easily wound around the transferring drum 13*a*, the sheet P can smoothly be carried. The upward curl of the sheet P is, at the time of transferring an image, maintained as indicated in (3).

The sheet P, to which the image has been transferred, is conveyed to the heat-fixing roller unit 19 in which heat and pressure are applied to the sheet P when the sheet P passes between the fixing roller 19*a* and a pressing roller 19*b* so that the image is fixed. At this time, the sheet P curled upwards as indicated in (3) is somewhat corrected so that the amount of curl is reduced or the sheet P is straightened. The foregoing state is realized if the quantity of the toner is uniformly placed on the sheet P. If no toner is placed on the sheet P, heat applied from the fixing roller 19*a* is dominant and, therefore the upward curl is retained as indicated in (4).

When the sheet P, to which the image has been fixed, is guided by the vertical path 22 to pass through the curl forming roller pair 76, the sponge roller 76*a* is deformed so that the sheet P is conveyed while being wound around the hard roller 76*b*. Therefore, the sheet P is, as indicated in (5) (although the sheet P is curled to the right in the drawing, the sheet P is curled downwards on the intermediate tray 25), curled in a direction opposing the direction of curl which has been formed.

Then, the sheet P is introduced into the reversing unit 23 so as to be guided by the reversing path 23*a* so that the sheet P is switched back by the reversing roller 23*b*. Thus, the sheet P is conveyed while being inverted longitudinally to pass through the side path 23*c*, followed by being discharged and stacked on the intermediate tray 25 by the reverse discharge roller 24 in such a manner that the first side, on which an image has been formed, faces upwards. At this time, the sheet P is stacked in such a manner that the sheet P is curled downwards as indicated in (6). The sheet P is, at this time, curled in a direction in which the sheet P can easily be wound around the transferring drum 13*a* when an image is formed on the second side of the sheet P.

The sheets P are stacked on the intermediate tray 25 as follows: a predetermined flapper is rotated in a state where the sweeping roller 27 and the pickup roller 28 are moved upwards so that the sheet P is introduced into the sheet stacking portion 32; the sweeping roller 27 and the pickup roller 28 are brought into contact with the sheet P so that the sheet P is conveyed until the leading portion of the sheet P comes in contact with the gate 26; the elastic sheet 45 is rotated once so that the front and rear ends of the uppermost sheet P are pressed. As a result, disorder of the sheets P occurring due to the upward warp of the sheet P causing the next sheet P to be introduced between the previous sheets P can be prevented and stacking is performed smoothly.

The sheets P are aligned and stacked in the sheet stacking portion 32 by the pickup roller 28 and the retard roller pairs 29 and 30 to form images on the second sides of the sheets P. Next, only the uppermost one of the sheets P is separated and conveyed to pass through the paper supplying path 31 and the sheet P is conveyed to the curl forming roller 75. When the sheet P passes through the curl forming roller 75, the sheet P is curled in a direction in which the sheet P can easily be wound around the transferring drum 13*a*. Although the sheet P is, at this time, curled in an opposite direction because the sheet P has been inverted with respect to forming of the image on the first side of the sheet P, the sheet P is curled along the curl forming roller pair 76 to cause the sheet P to be easily wound around the transferring drum 13*a*. After images have been formed on the two sides of the sheets P, the conveyance-path switching guide 21 is switched so that the sheets P are discharged and stacked on the discharge tray 20 in such a manner that the first sides, on which the images have been formed, face downwards. Since each sheet P is sufficiently drawn in the transferring portion and the fixing portion in such a manner that the two sides and the front and rear ends are inverted, the sheet P can be stacked on the discharge tray while being straightened.

Since the curl forming roller 75 and the curl forming roller pair 76 are provided to curl the sheets P, the positions may be interchanged or the rollers may be the same rollers.

According to the foregoing structure, images are formed on the two sides of sheets in such a manner that the sheets P are curled in a direction in which the sheets P can easily be wound around the transferring drum 13*a* at the time of forming images on the second sides of the sheets P. Therefore, the sheet P can be carried stably. In particular, the curl forming roller pair 76 curls the sheet P in the direction opposing the direction in which the sheet P has been curled after fixing. Therefore, the sheets P can be conveyed stably after the sheets P have passed through the curl forming roller pair 76.

Since the front and rear ends of the sheet P, which has been curled, are pressed by the elastic sheet 45 in the intermediate tray 25, the sheets P can stably be stacked on the intermediate tray 25.

Second Embodiment

A second embodiment of the image forming apparatus will now be described with reference to FIG. 2. Since the color copying machine has a similar structure to that of the foregoing embodiment, the same elements are given the same reference numerals and their descriptions are omitted. The description will be made about only the characteristic structures.

If the overall body of the apparatus has been cooled, for example, in early morning, the sheet P heated by the fixing unit 19 and toner are rapidly cooled when the sheet P passes through the guide plate of the vertical path 22 and the curl forming roller pair 76. Therefore, the sheet P is curled excessively, thus arising a risk that the sheets P cannot be smoothly stacked in the intermediate tray 25 or conveyed as desired. To prevent this, a heater may be provided for each of the guide plate and the curl forming roller pair 76. However, since electric power consumption increases and the maximum electric current is limited, the provision of the heater results in an unsatisfactory effect.

Accordingly, this embodiment has a structure as shown in FIG. 2 in which the reversing unit 23 and the intermediate tray 25 are disposed upper than the large-size sheet cassettes 16*a* and 16*b*; and the reversing unit 23 is disposed to oppose (in the left portion of the drawing) the pickup roller 28 of the intermediate tray 25. Furthermore, an electric unit, specifically, a control and drive low-voltage power source S, capable of rapidly raising the temperature is disposed in a space below the reversing unit 23 and opposing (in the left portion of the drawing) the sheet feeding side of the large-side sheet cassettes 16*a* and 16*b* so as to heat the reversing unit 23 and the curl forming roller pair 76 with hot air upwards moved from the low-voltage power source S. As a result, the degree of curl formed by curl forming roller pair 76 is stabilized and the sheets P can be conveyed stably.

According to the foregoing structure, even if the overall body of the apparatus has been cooled, for example, in early morning, the portion above the low-voltage power source S has been heated and therefore excessive curl formed by the curl forming roller pair 76 can be prevented. A problem experienced with the conventional apparatus having a structure, in which the intermediate tray is disposed below the large-size sheet cassettes can be prevented, the problem being a problem that only a small-size and low-voltage power source is allowed to be disposed below the reversing unit and therefore the space in the apparatus cannot be used efficiently; the temperature in the apparatus cannot be raised sufficiently because only a small-size power source is permitted to be provided; and the distance from the curl forming roller is lengthened excessively to satisfactorily raise the temperature. Thus, the present invention enables the reversing unit 23 and the curl forming roller pair 76 to be efficiently heated.

The image forming apparatus according to the present invention comprises the first curl forming means disposed between the image fixing means for fixing an image formed on a sheet and the reversing means for conveying the sheet while reversing the sheet. Therefore, the sheet can be curled in a direction in which the sheet can easily be carried by the sheet carrier. Thus, the performance of carrying the sheet can be improved.

Since the pressing means for pressing the sheet in the direction, in which the curl formed by the first curl forming means is corrected, the sheets can be stably discharged and stacked onto the intermediate stacking means.

The image forming apparatus according to the present invention comprises the reversing means and the intermediate stacking means disposed above the sheet accommodating means; and the heating electric unit disposed below the reversing unit and to oppose the sheet feeding side of the sheet accommodating means to heat the first curl forming means with the heat of the electric unit. Thus, even if the body of the apparatus is cold, the degree of curl formed by the first curl forming means is stabilized so that the sheets are stably conveyed.

Figure 5:
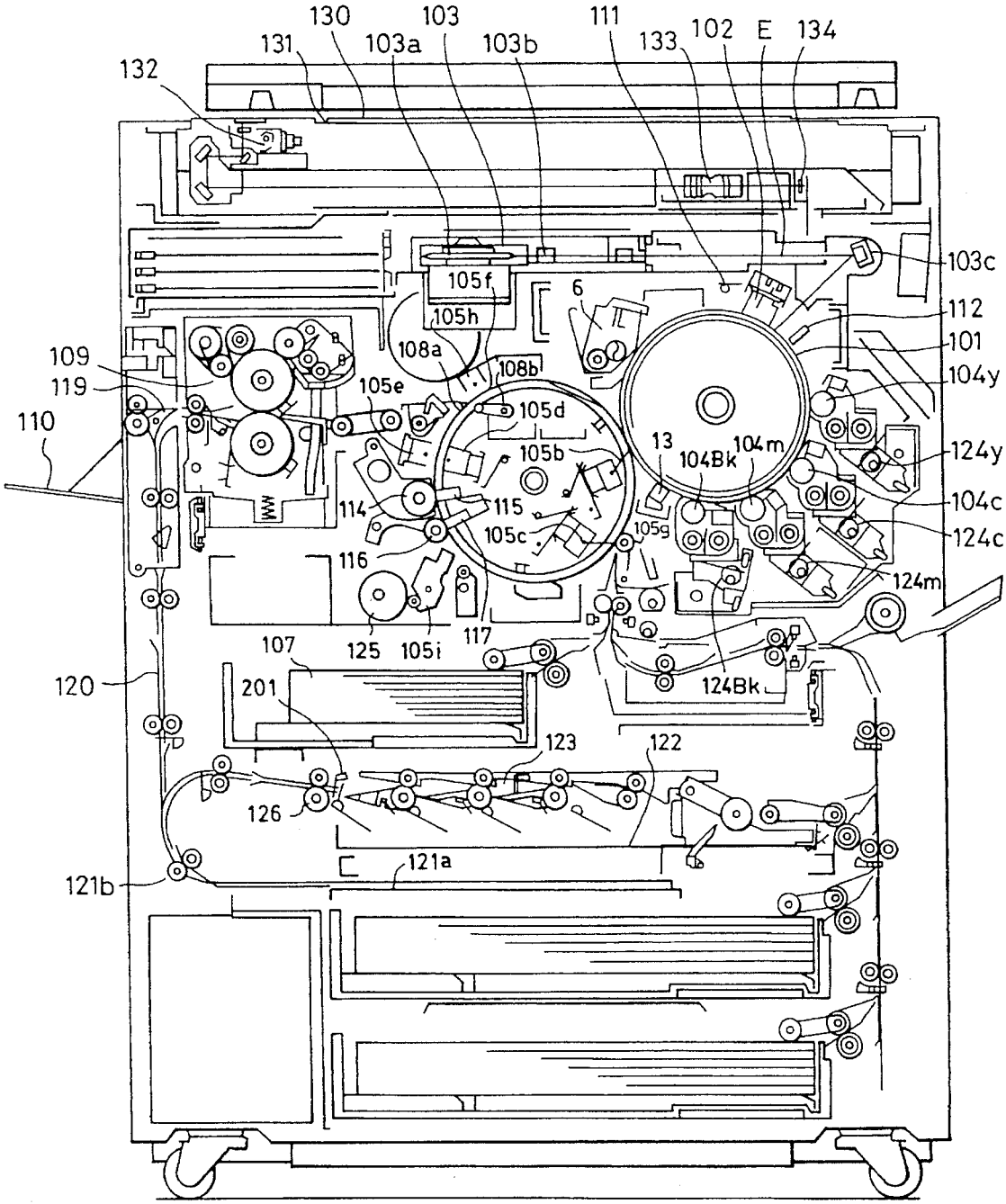
FIG. 5 is a schematic view of an image forming apparatus according to the present invention.

FIG. 5 is a schematic cross sectional view of a color image forming apparatus according to a third embodiment of the present invention.

The color image forming apparatus according to this embodiment comprises a digital color image reader portion in the upper portion thereof and a digital color image printer portion in the lower portion thereof.

In the reader portion, an original document 130 is placed on an original-document retaining glass 131 and the original document 130 is exposed to light and scanned by an exposing lamp 132. Thus, a reflected optical image from the original document 130 is, by a lens 133, converged onto a full-color sensor 134 so that a color-decomposed image signal is obtained. The color-decomposed image signal is supplied to an amplifying circuit (not shown), and then it is processed by a video processing unit (not shown) and transferred to the printer portion.

In the printer portion, a photosensitive drum 101 serving as an image carrier is rotatively supported in a direction indicated by an arrow shown in FIG. 5. Around the photosensitive drum 101, the following units are disposed: a previously exposing lamp 111, a corona charger 102, a laser exposing optical system 103, a potential sensor 112, developing units 104*y*, 104*c*, 104*m* and 104Bk for the corresponding colors, a means 113 for detecting the quantity of light on the photosensitive drum 101, a transferring unit 105 and a cleaning unit 106.

In the laser exposing optical system 103, an image signal from the reader portion is converted into an optical signal in a laser output portion (not shown). The converted laser beam is reflected by a polygonal mirror 103*a*, and the laser beam is allowed to pass through a lens 103*b* and a mirror 103*c* so that the laser beam is projected to the outer surface of the photosensitive drum 101.

When an image is formed in the printer portion, the photosensitive drum 101, from which electricity has been removed by the previously exposing lamp 111, is rotated in the direction indicated by the arrow shown in FIG. 5 to uniformly charge the photosensitive drum 101 by the corona charger 102. As a result, the optical image E is irradiated for each decomposed color so that a latent image is formed.

Then, predetermined developing units are operated to develop the latent image on the photosensitive drum 101 so that a toner image containing resin as a basic material thereof is formed on the photosensitive drum 101. The developing units 104*y*, 104*c*, 104*m* and 104Bk for the decomposed colors are caused to selectively approach the photosensitive drum 101 due to the operations of eccentric cams 124*y*, 124*c*, 124*m* and 124Bk.

The toner image on the photosensitive drum 101 is transferred onto a sheet supplied from a sheet cassette 107 through a conveyance system and a transferring unit 105 to a position facing the photosensitive drum 101. The transferring unit 105 according to this embodiment comprises the transferring drum 105*a*, the transferring charger 105*b*, an adsorption roller 13*d* facing an adsorption charger 105*c* for electrostatically adsorbing the sheet, an internal charger 105*d* and an external charger 105*e*. A dielectric sheet carrier 105*f* in the form of a cylinder is applied to be integrated with the outer surface of the transferring drum 105*a* which is rotatively supported. The sheet carrier 105*f* is made of a dielectric sheet, such as a polycarbonate film.

As the transferring unit 105 in the form of a drum, that is, the transferring drum 105*a*, is rotated, the toner image on the photosensitive drum 101 is, by the transference charger 105*b*, transferred onto a sheet carried by the sheet carrier 105*f*.

Thus, a desired number of color images are transferred to the sheet adsorbed and conveyed by the sheet carrier 105*f* so that a full color image is formed.

In a case where a full color image is formed, toner images of four colors are transferred, and then the sheet is separated from the transferring drum 105*a* by a separating claw 108*a*, a separating and pushing roller 108*b* and a separation charger 105*h*. As a result, the sheet is discharged onto a tray 110 through a heat-fixing roller unit (hereinafter called a "fixing unit) 109.

On the other hand, after the toner image has been transferred, toner left on the surface of the transferring drum 105*a* is cleaned by the cleaning unit 106 and again used to the next image forming process.

In a case where images are formed on the two sides of the sheet, the sheet is discharged from the fixing unit 109, and immediately a conveyance-path switching guide 119 is operated to cause the sheet to pass through a vertical conveyance path 120 so as to be temporarily introduced into a reversing path 121*a*. Then, the reversing roller 121*b* is rotated inversely so that the rear end of the sheet at the time of feeding is made to be the leading portion and the sheet is discharged in the direction opposing the direction at the time of feeding. Then, the sheet is accommodated in an intermediate tray 122 serving as a sheet stacking means. Then, the foregoing image forming process is again performed so that an image is formed on the second side of the sheet.

To prevent adhesion of flying toner to the surface of the sheet carrier 105*f* of the transferring drum 105*a* and adhesion of oil to the sheet, cleaning is performed by a fur brush 114, a backup brush 115 facing the fur brush 114 through the sheet carrier 105*f*, an oil removing roller 116, and a backup brush 117 facing the oil removing roller 116 through the sheet carrier 105*f*. The cleaning operation is performed before or after an image is formed. If paper jamming takes place, cleaning is performed at any time.

In this embodiment, an eccentric cam 125 is operated at a desired timing so that a cam follower 105*i* integrated with the transferring drum 105*a* is operated. As a result, the gap between the sheet carrier 105*f* and the photosensitive drum 101 can be set arbitrarily. At the time of standby for forming an image or if supply of electric power is turned off, the distance from the transferring drum 105*a* to the photosensitive drum 101 is lengthened.

The structure of the intermediate tray of the image forming apparatus according to this embodiment will now be described.

Figure 6:
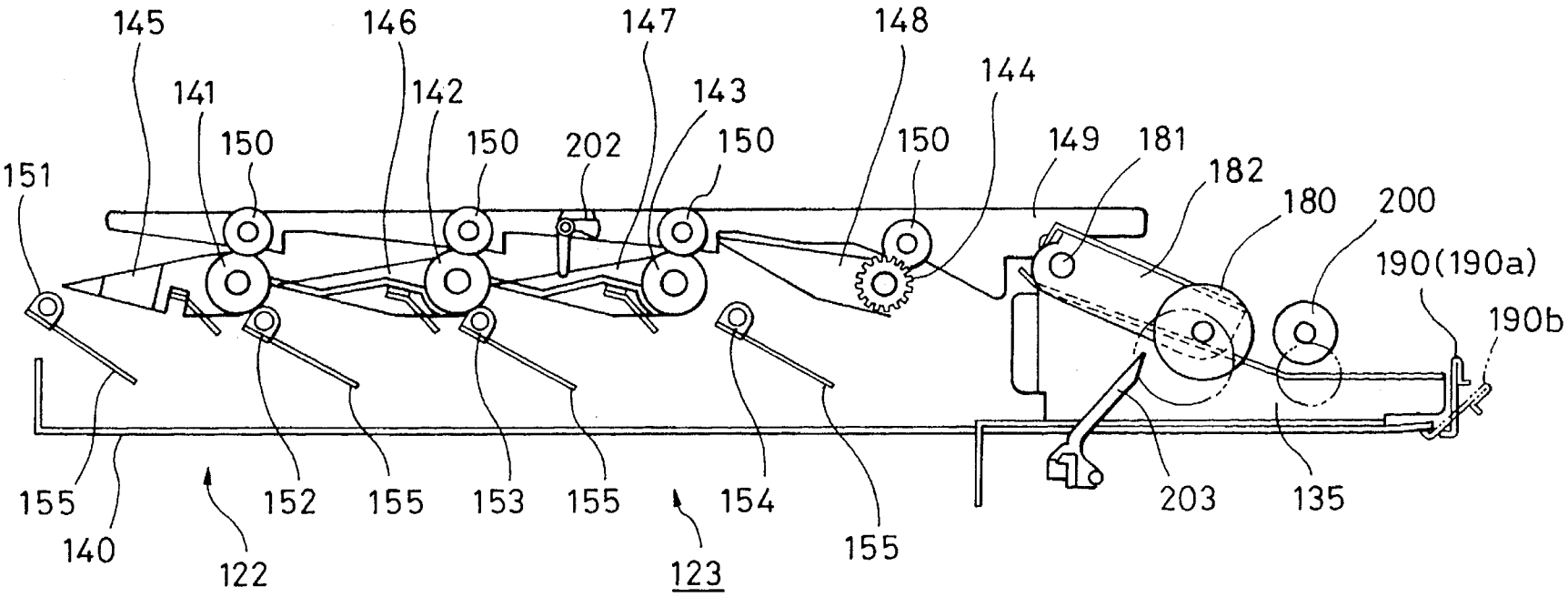
FIG. 6 is a cross sectional view of the intermediate tray of the image forming apparatus according to a third embodiment of the present invention.
Figure 7:
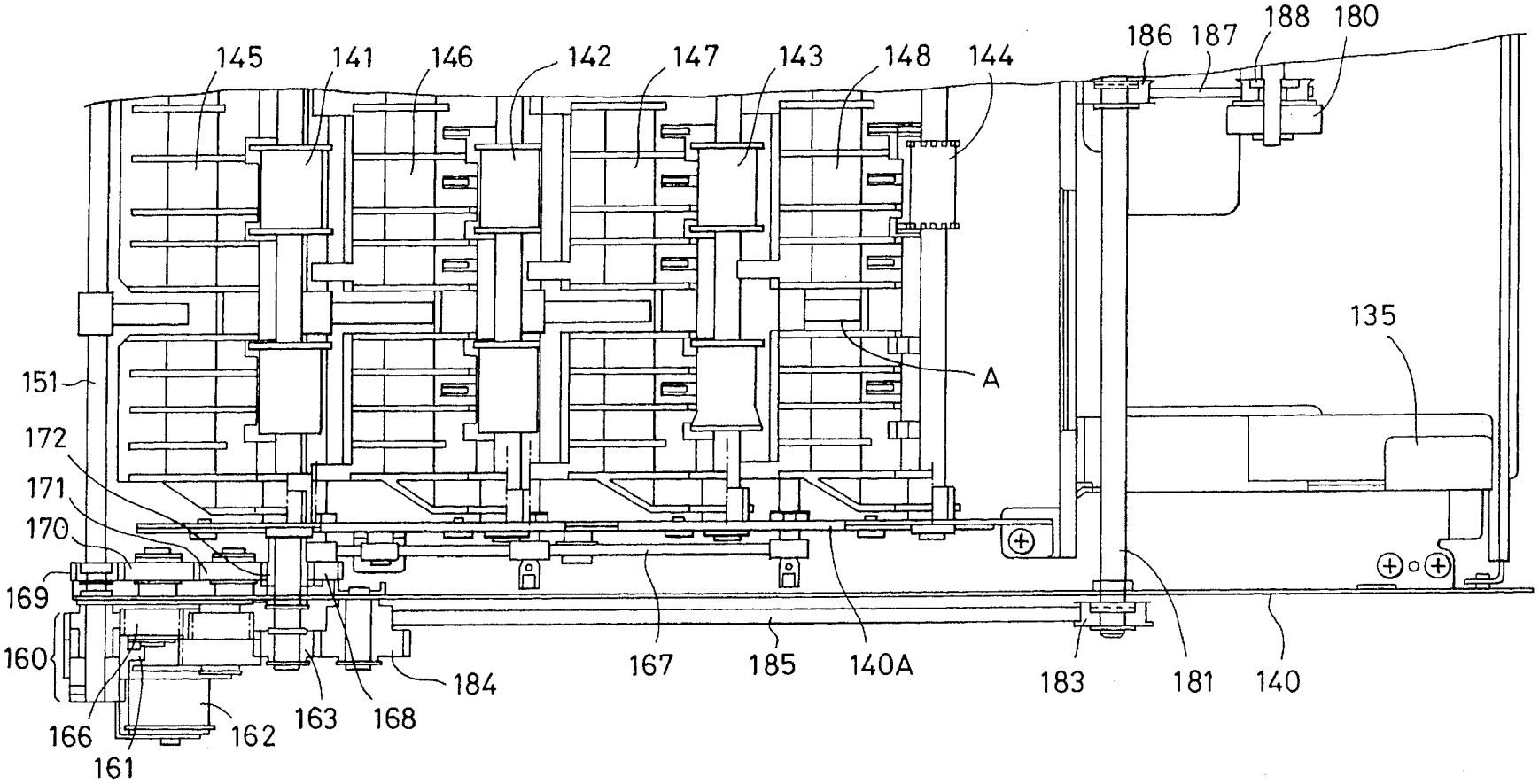
FIG. 7 is a plan view of the intermediate tray shown in FIG. 6.

FIG. 6 is a schematic cross sectional view of the intermediate tray 123. FIG. 7 is a schematic plan view of the intermediate tray 123.

A first conveying roller 141 is rotatively supported by the side plate of the frame 140. A conveyance support plate 140A is rotatively secured on the shaft of the first conveying roller 141 through a bearing. A first flapper 145 is, through a bearing, movably supported. A second conveying roller 142, a third conveying roller 143, a fourth conveying roller 144, a second flapper 146, a third flapper 147 and a fourth flapper 148 are respectively supported by a conveyance support plate 140A in such a manner that the conveying rollers 142, 143 and 144 are rotatively supported and the flappers 146, 147 and 148 are movably supported. The first conveying roller 141 to the fourth conveying roller 144 respectively are connected to each other by a belt arranged among pulleys fixed to the conveying roller shafts. The main power source (not shown) of the body of the apparatus is transmitted to the respective conveying rollers through a coupling secured to the first conveying roller 141 so as to be rotated in the same direction.

Furthermore, conveying rollers 150 respectively supported on the conveyance guide 149 are brought into contact with the conveying rollers 141 to 144 so as to sequentially and downstream convey the sheets discharged from the reversing unit by the first conveying roller 141.

The first flapper 145 to the fourth flapper 148 are respectively provided with drive means (not shown), such as electromagnetic solenoids, so as to independently turned on/off. In accordance with the size of the sheet, the flappers 145 to 148 are vertically moved to determine the port through which the sheet is discharged.

A first roller shaft 151 rotatively supported through a bearing is disposed on the side plate of the frame 140, the first roller shaft 151 being disposed near a discharge roller 126 of the reversing unit. An elastic member 155 serving as a pressing member having a predetermined length and a predetermined width is secured to the first roller shaft 151. A spring clutch 160 having a control ring 161 is provided on the first roller shaft 151.

Figure 8:
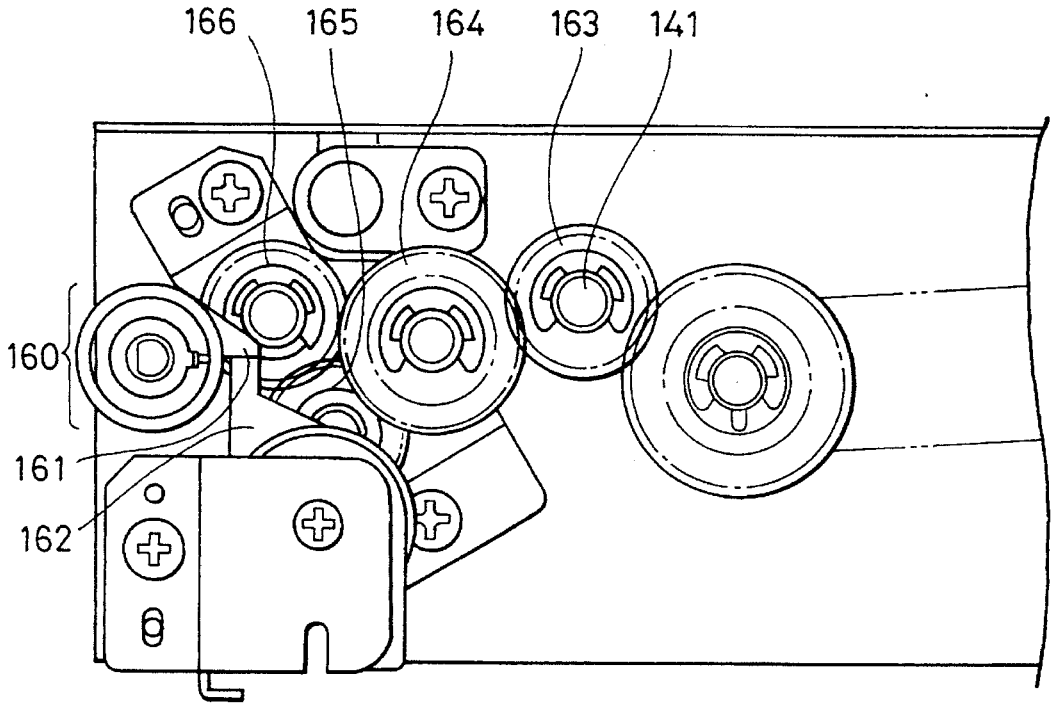
FIG. 8 is a side view of the drive portion shown in FIG. 7.

The rotational force is transmitted from a gear 163 secured to another end of the first conveying roller 141 to the foregoing spring clutch 160 through idler gears 164, 165 and 166. An electromagnetic solenoid 162 disposed adjacent to the spring clutch 160 enables an intermittent rotational operation in which the spring clutch 160 rotates once from a position making a predetermined angle and returns to a predetermined position making a predetermined angle within a predetermined time (see FIG. 8).

Second, third and fourth roller shaft 152, 153 and 154 are, through bearings, rotatively supported by the conveyance support plate 140A at positions adjacent to the second, third and fourth conveying rollers 142, 143 and 144.

Similarly to the first roller shaft 151, elastic sheets 155 are respectively secured to the roller shafts 151 to 154. A belt 167 is arranged between pulleys respectively secured to the ends of the roller shafts 151 to 154. The rotational force is, through idler gears 170 to 172, transmitted to a gear 168 secured to an end of the second roller shaft 152 and a gear 169 secured to the first roller shaft 151. Thus, the elastic sheets 155 are respectively rotated once from positions each making a predetermined angle and returned to the original positions in synchronization with the one intermittent rotation of the first roller shaft 151.

A drive shaft 181 for rotating a sweeping roller 180 is rotatively supported by the frame 140 through a bearing, the drive shaft 181 being disposed downstream from the fourth conveying roller 144. The sweeping roller 180 is rotatively supported by a moving plate 182 disposed in the central portion of the drive shaft 181. A pulley 183 secured to an end of the drive shaft 181 is connected to a gear pulley 184 through a belt 185, the gear pulley 184 being engaged to the gear 163 secured to the first conveying roller 141. The rotational force is transmitted to the sweeping roller 180 by the drive shaft 181 through the pulley 186, the belt 187 and the pulley 188.

The moving plate rotatively supporting the sweeping roller 180 is upwards pulled by a spring member (not shown). A drive means, such as an electromagnetic solenoid (not shown), and the moving plate 182 are engaged to each other. When the drive means is turned on/off, the sweeping roller 180 is brought into contact with/separated from the sheet for a predetermined time.

The sweeping roller 180 is brought into contact with the sheet due to the dead weight thereof. As the sheets are stacked, the sweeping roller 180 is moved upwards. A shutter 190 is rotatively supported by the frame 140. When sheets are stacked onto the intermediate tray 122 by a drive means (not shown), the shutter 190 is rotated to a closing position 190*a* and rotated to an opening position 190*b* when the sheets are again supplied after stacking has been completed.

A pickup roller 200 for again supplying sheets that is able to approach and separate from the body of the apparatus is disposed on the conveyance path from the sweeping roller 180 to the shutter 190 so as to be brought into contact with the uppermost one of the stacked sheets after stacking has been completed to again supply the sheets downstream.

Sheet detection means 201, 202 and 203 each comprising a phototransistor are disposed downstream from the discharge roller 126 of the reversing portion, in the conveyance path from the second conveying roller 142 to the third conveying roller 143 and downstream from the sweeping roller 180.

A side regulating means for regulating and aligning the side ends of the sheets is disposed at the leading portion of the intermediate tray 122. Whenever one sheet is stacked, the side regulating plates 135 approach (regulate the sides of the sheets) or separate each other (standby position) so that the side ends of the sheets are aligned.

The operation of the image forming apparatus according to this embodiment will now be described with reference to FIGS. 9 to 15.

Sheets, on which images for their one sides have been formed, are discharged from the fixing unit 109, and then the conveyance-path switching guide 119 is switched to cause the sheet to pass through the vertical conveyance path 120 to be temporarily introduced into the reversing path 121*a*. Then, the reversing roller 121*b* are inversely rotated so that the rear end of the sheet when the sheet has been supplied is made to be the leading portion so as to be discharged in a direction opposing the direction when the sheet has been supplied. The reversing path switching means is operated to convey the sheet to the reversing conveyance path. Then, the sheet is, by the discharge roller 126, conveyed to the conveyance portion connected to the intermediate tray 122.

Figure 9:
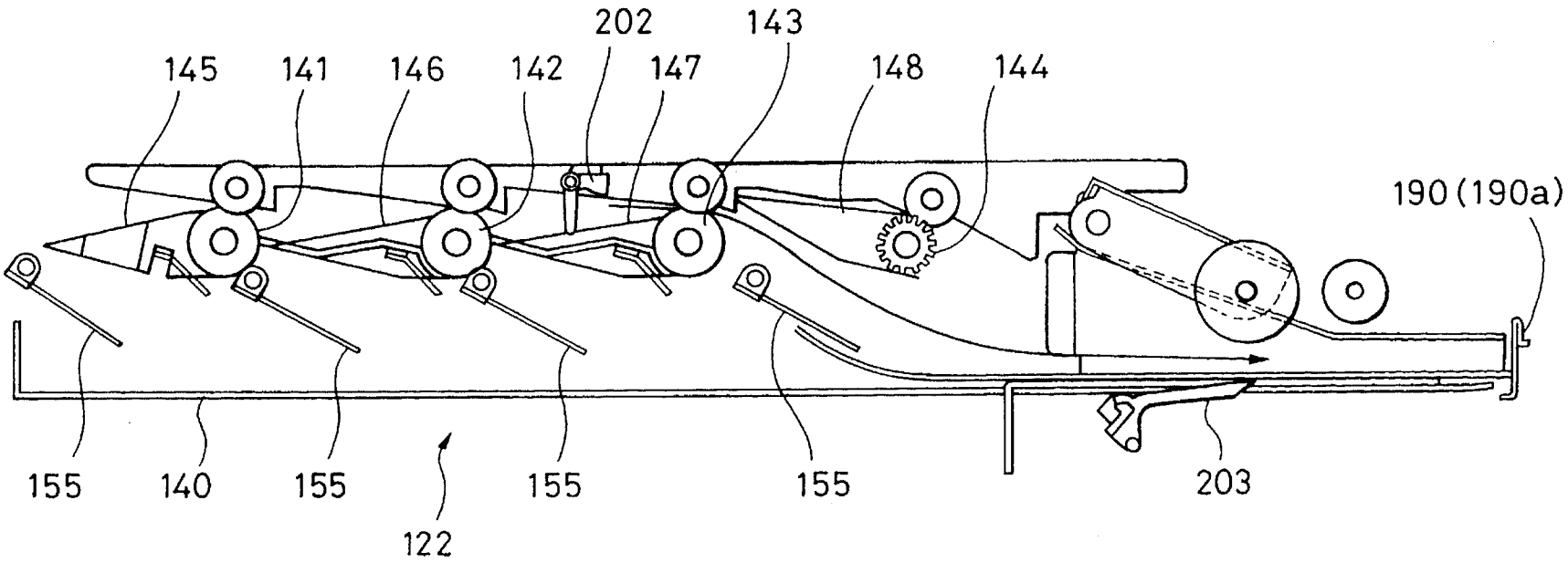
FIG. 9 is a cross sectional view showing the operation of the image forming apparatus according to the present invention.

The discharged sheets cause any one of the first to fourth flappers 145 to 148 to be selectively rotated in accordance with the size of the sheets so as to be discharged into a stacking and accommodating portion of the intermediate tray 122 (see FIG. 9).

According to this embodiment, if A4-size sheets are used, the fourth flapper 148 is rotated upwards, and the third conveying roller 143 discharges the sheets to the accommodating portion of the intermediate tray 122. Then, the description will be made about the operation when A4-size sheets are used.

Figure 10:
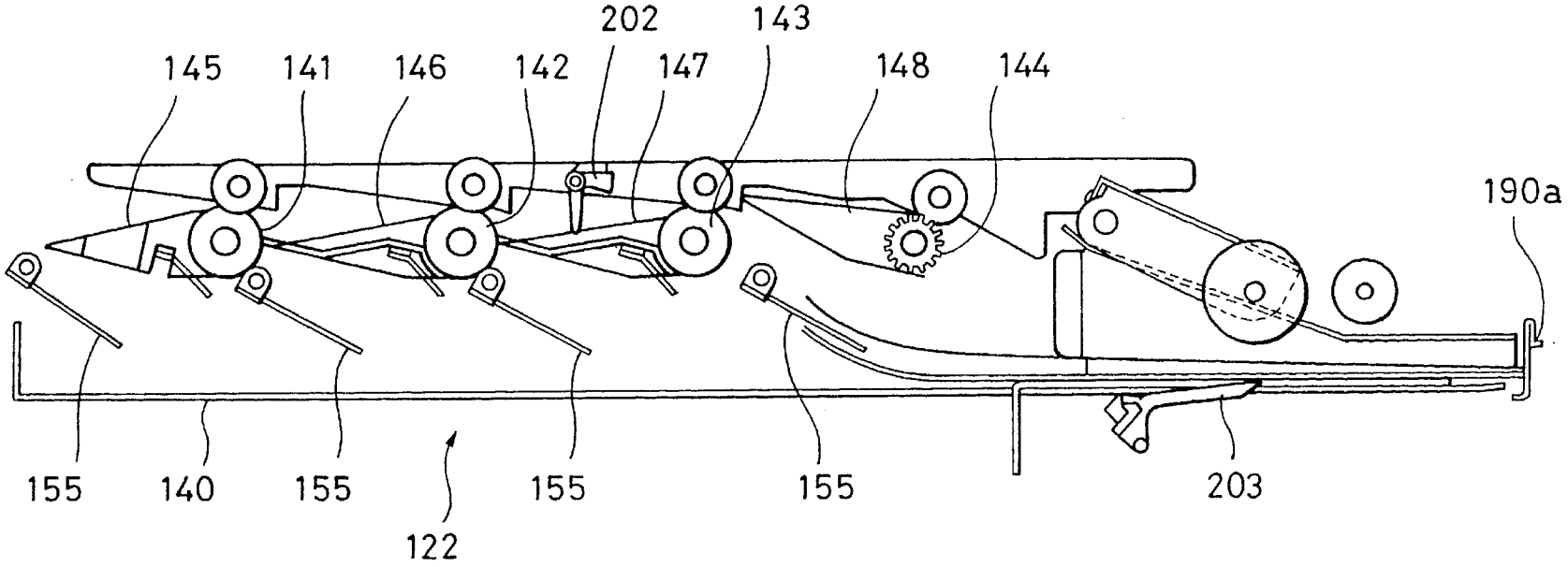
FIG. 10 is a cross sectional view showing the operation of the image forming apparatus according to the present invention.
Figure 11:
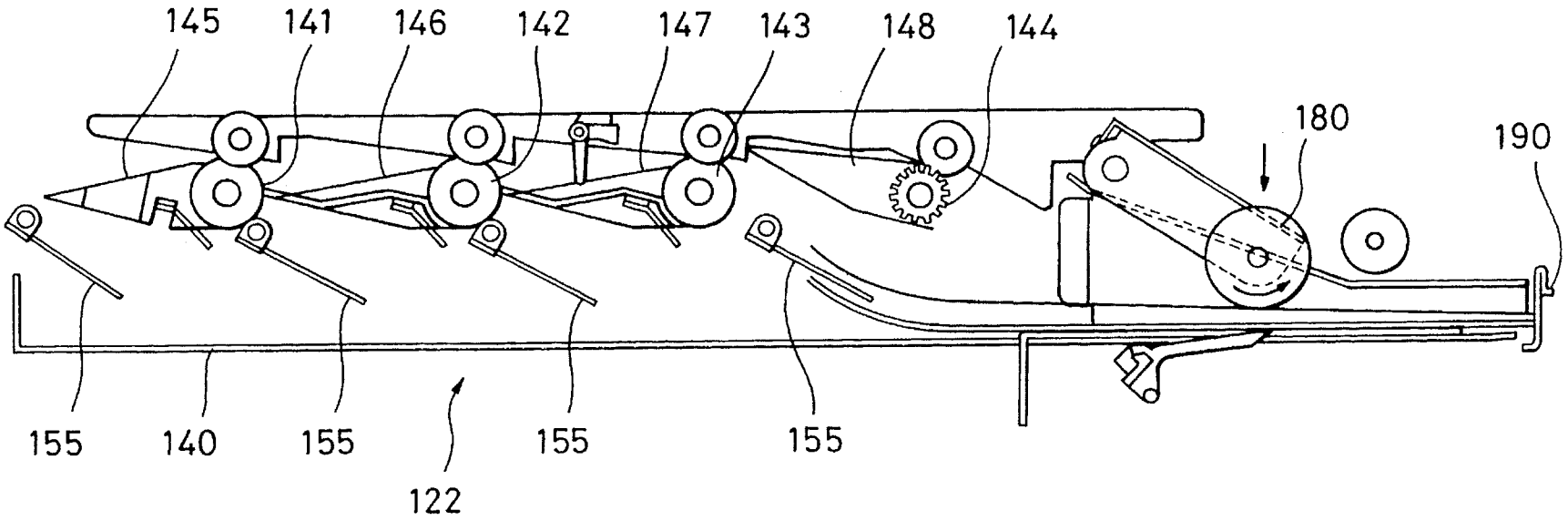
FIG. 11 is a cross sectional view showing the operation of the image forming apparatus according to the present invention.

The leading portion of the discharged sheet is brought into contact with the shutter 190 maintained at the closing position (190*a*) and the sheet is stopped (see FIG. 10). To reliably bring the leading portion of the stopped sheet into contact with the shutter 190 and align the sheets, the sweeping roller 180 is brought into contact with the sheets for a predetermined time (see FIG. 11).

After sweeping has been completed, the side regulating plates 135, which have been positioned away from each other for a distance longer than the width of the A4 size to discharge the sheets, are made approach each other to regulate the side ends of the sheets and again align the sheets, followed by again separating from each other to a standby position.

Figure 12:
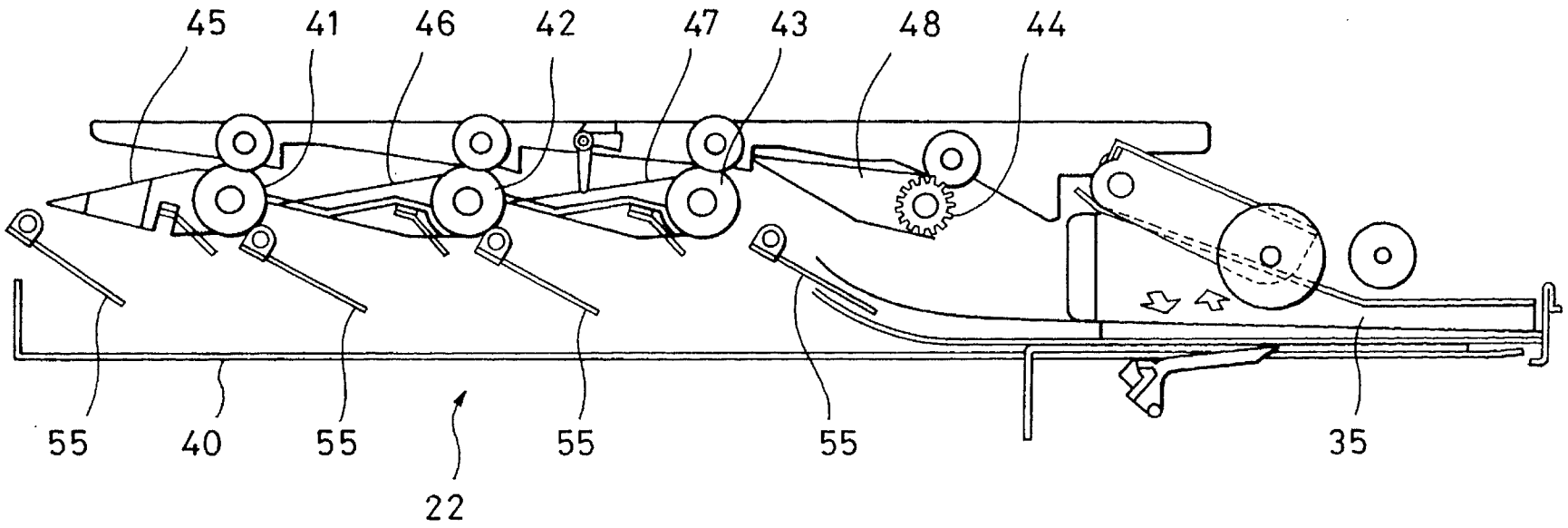
FIG. 12 is a cross sectional view showing the operation of the image forming apparatus according to the present invention.
Figure 13:
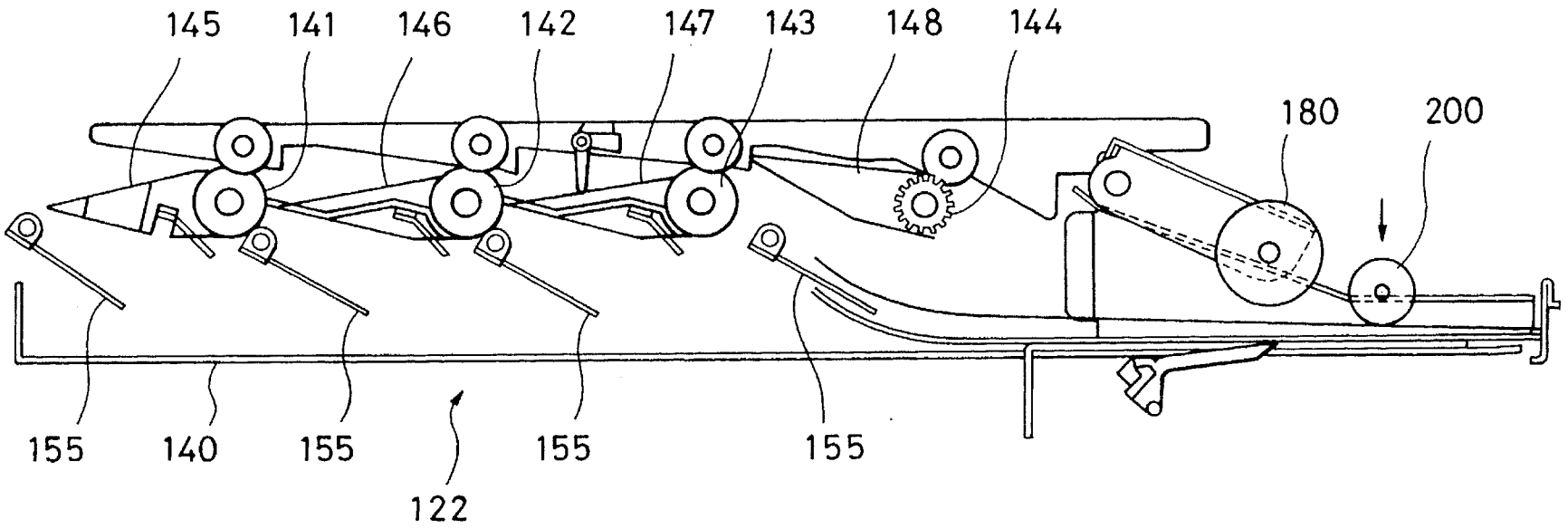
FIG. 13 is a cross sectional view showing the operation of the image forming apparatus according to the present invention.
Figure 14:
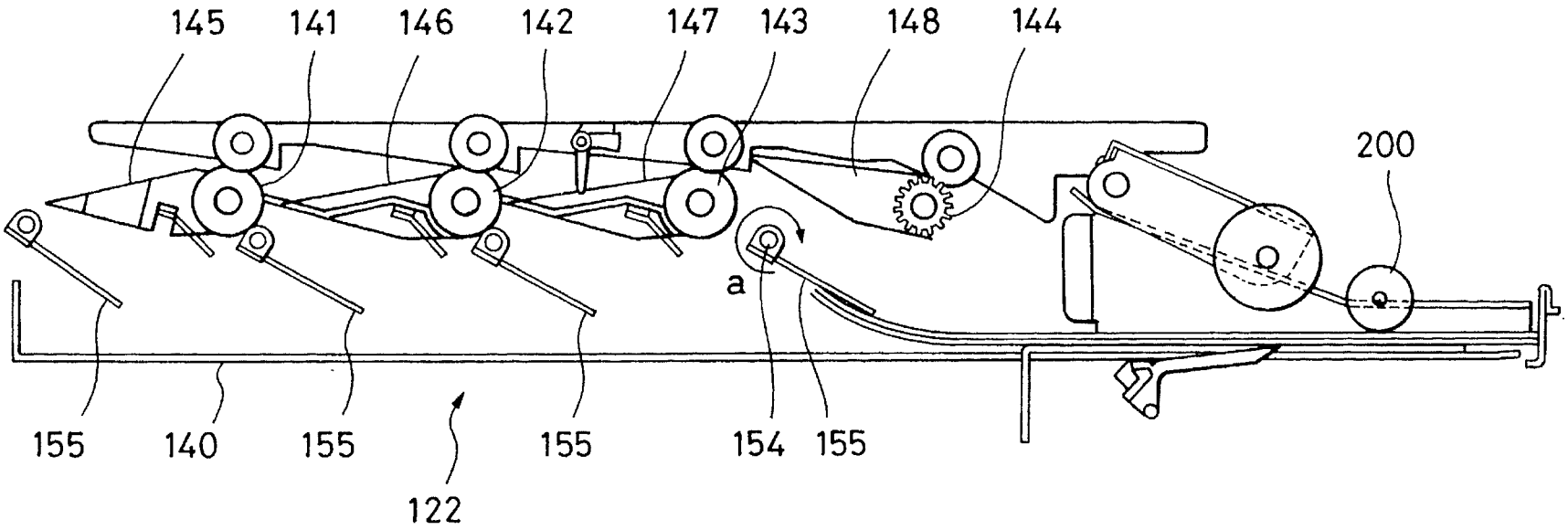
FIG. 14 is a cross sectional view showing the operation of the image forming apparatus according to the present invention.
Figure 15:
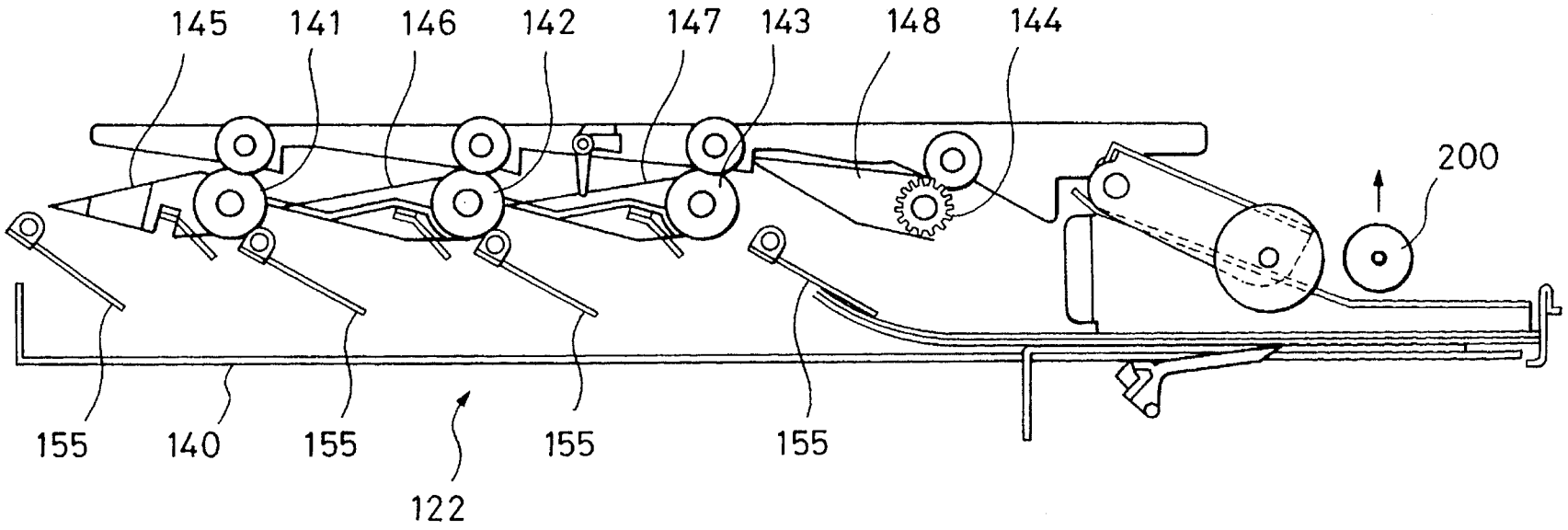
FIG. 15 is a cross sectional view showing the operation of the image forming apparatus according to the present invention.

At this time, the rear end of the sheet is reliably discharged by the third conveying roller 143 onto the elastic member 155 which is a third urging means (see FIG. 12). As a result, the pickup roller 200 is brought into contact with the sheet to prevent rearward movement of the sheet (see FIG. 13).

The electromagnetic solenoid 162 shown in FIG. 7 is turned on or off so that the first roller shaft 151 is rotated once. Thus, the elastic member 155 made of rubber or the like starts rotating from a position making a predetermined angle into a direction indicated by symbol a shown in FIG. 14. As the rotation proceeds, the sheet passes through the third conveying roller 143 and a cut portion A (see FIG. 7) of the third flapper 147 due to the elasticity and rotated to a position making a predetermined angle. Thus, the rear end of the sheet is switched to a position below the elastic member 155 to prevent forming of curl. As a result, a reliable path is maintained between the fourth flapper 148 and the elastic member 155 (see FIG. 14).

In this embodiment, four elastic members 155 are disposed so as to be rotated simultaneously so that warp (curl) of large-size sheet in any portion can be prevented. The pickup roller 100 is separated and brought to a standby state (see FIG. 15).

When a plurality of sheets are stacked, the shutter 190 is opened after a predetermined number of sheets have been stacked. Then, the pickup roller 200 initially picks up the uppermost sheet and second images are formed on the second sides of the sheets by the foregoing image forming process.

Although the description has been made about the operation for the A4-size sheets, a similar operation is performed.

As a result of the foregoing structure, the sheets on the intermediate tray 122 serving as the sheet stacking means are pressed against the elastic member 155 serving as the pressing member. Thus, warp (curl) is prevented and, therefore, defects in conveyance and defective image, such as miss transference, caused from warp can be prevented even if the sheet is again supplied and images are formed.

Fourth Embodiment

Figure 16:
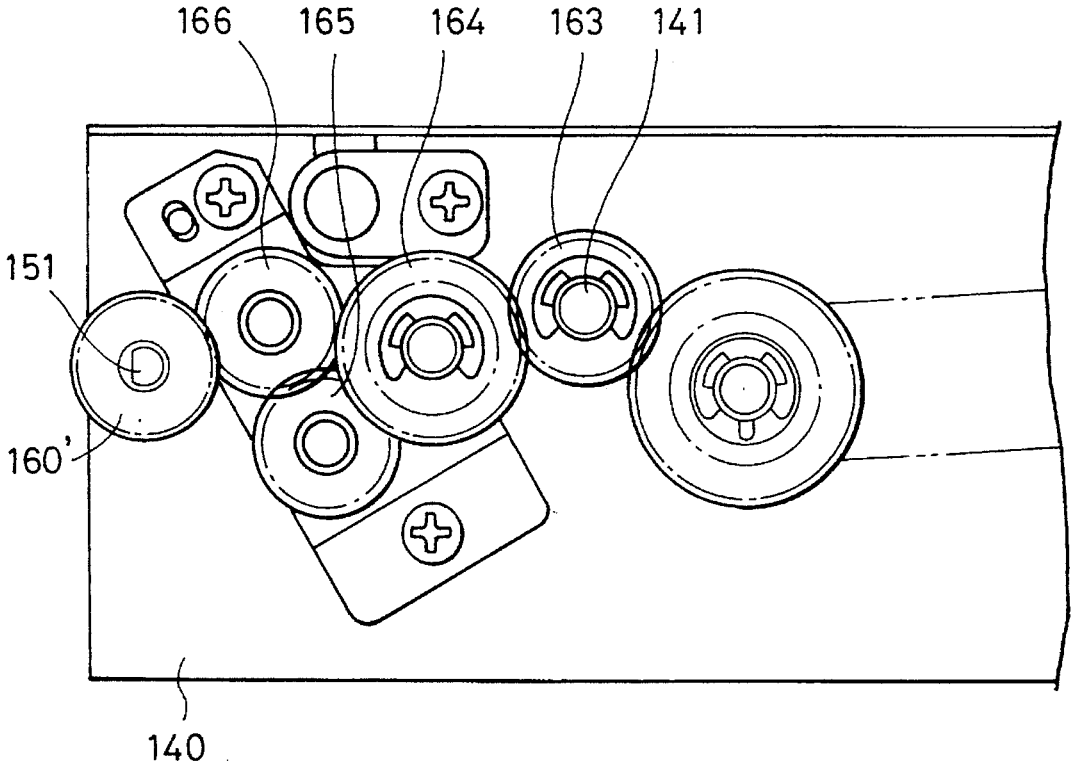
FIG. 16 is a side view showing a drive portion of the intermediate tray of the image forming apparatus according to a fourth embodiment of the present invention.

FIG. 16 is a diagram showing the characteristic of the fourth embodiment.

A first conveying roller 141 is, through a bearing, rotatively supported by the side plate of a frame 140. A coupling (not shown) is secured to an end of the first conveying roller 141 so that rotational force is transmitted from a main power source (not shown) of the body of the apparatus through the coupling. On the other hand, a gear 163 is secured to another end of the first conveying roller 141 so that the rotational force is, through idler gears 64, 165 and 166, transmitted to a gear 160' secured to an end of a first roller shaft 151 rotatively supported by the side plate of the frame 140 through a bearing similarly to the first conveying roller 141.

As a result, the first roller shaft 151 is always rotated in the same direction as the direction of rotation of the first conveying roller 141 (it is rotated intermittently in the third embodiment).

An elastic member 155 made of PET or the like is secured to the first roller shaft 151.

As a result of the foregoing structure, the electromagnetic solenoid 162 according to the third embodiment can be omitted and thus the cost can be reduced.

The other structures are the same as those of the third embodiment.

The operation of this embodiment will now be described.

Similarly to the third embodiment, sheets, on which images have been formed on the first sides thereof, are discharged to a conveyance portion of the intermediate tray 122.

The description will be made about a case where A4-size sheets are used. The discharged sheets are conveyed from the first conveying roller 141 to the second conveying roller 142. At this time, the first roller shaft 151 is being rotated always and the elastic member 155 secured onto the first roller shaft 151 passes through the conveyance path while traversing the same and rotates. The moving speed for the elastic member 155 on the path is made faster than the conveyance speed realized by the conveying roller so that the conveyance of the sheet is not interrupted.

The fourth flapper 148 is rotated upwards, and the third conveying roller 143 discharges the sheet to the accommodating portion of the intermediate tray 122. Then, similarly to the first embodiment, the shutter 190, the sweeping roller 180 and the side regulating member 135 align the leading portions and side ends of the sheets.

At this time, the rear end of the sheet is always urged downwards by the rotating elastic member 155 so that forming of warp (curl) of the sheet is prevented. The rear end of the sheet is separated from the third flapper 147 to secure the path for the sheet to be accommodated next.

Also the fourth embodiment provides a similar effect to that obtainable from the third embodiment.

Fifth Embodiment

Figure 17:
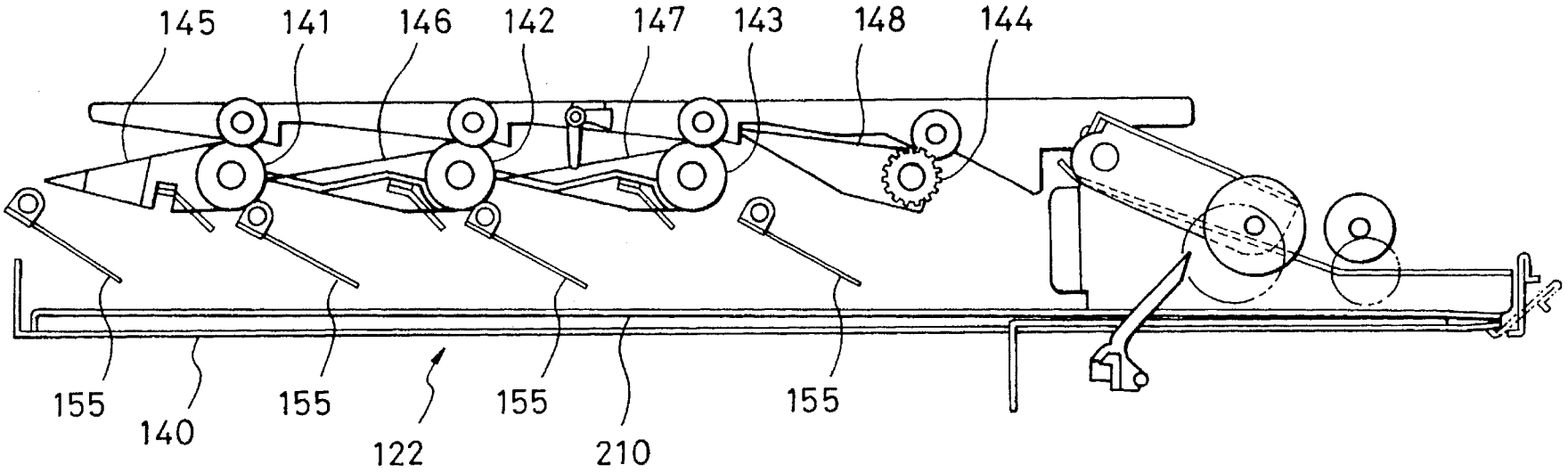
FIG. 17 is a cross sectional view showing the intermediate tray portion of the image forming apparatus according to a fifth embodiment of the present invention.

FIG. 17 is a cross sectional view showing the characteristic of a fifth embodiment of the present invention.

In this embodiment, a temperature adjustment means 210, such as a heater, is provided for the bottom surface of the intermediate tray 122 according to the third embodiment.

According to the foregoing structure, the elastic member 155 is rotated similarly to the third and fourth embodiments to bring the sheet into contact with the bottom surface of the intermediate tray 122. As a result, the sheet can be maintained at a high temperature by the temperature adjustment means 210 so that warp (curl) of the sheet can be further prevented.

When images are formed and fixed to the second sides of the sheets, undesirable deriving of heat from the fixing unit and the like to the sheet can be prevented.

Since this embodiment of the present invention has the foregoing structure and operation such that the pressing member for pressing at least the rear end of the sheet is provided for the sheet stacking means, warp of the sheets can be prevented. Therefore, defects in conveyance, such as jamming and defective images, such as miss in transference, occurring due to warp can be prevented.

If a plurality of pressing members are disposed on the stacking means, the apparatus is able to use a plurality of sheet sizes.

Since the pressing member is made of an elastic material, the force for pressing the sheet can be adjusted.

The temperature adjustment means provided for the sheet stacking means heats the sheet before the sheet is pressed. Thus, the sheet is effectively pressed so that warp is further prevented.

Since the temperature adjustment means is provided for the bottom surface of the sheet stacking means, the sheet can easily be brought into contact with the temperature adjustment means so that the heat conductivity is improved.

Sixth Embodiment

Figure 18:
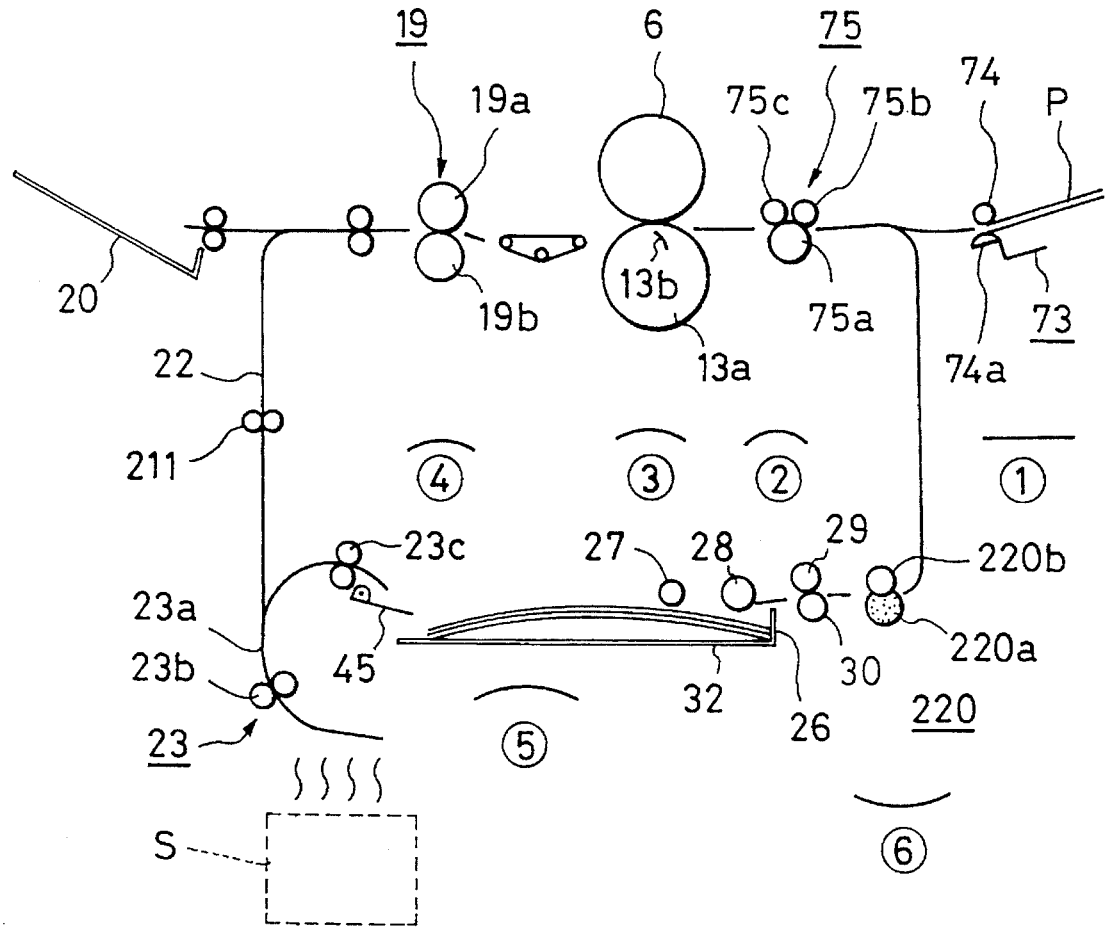
FIG. 18 is a schematic view of the color copying machine.
Figure 19:
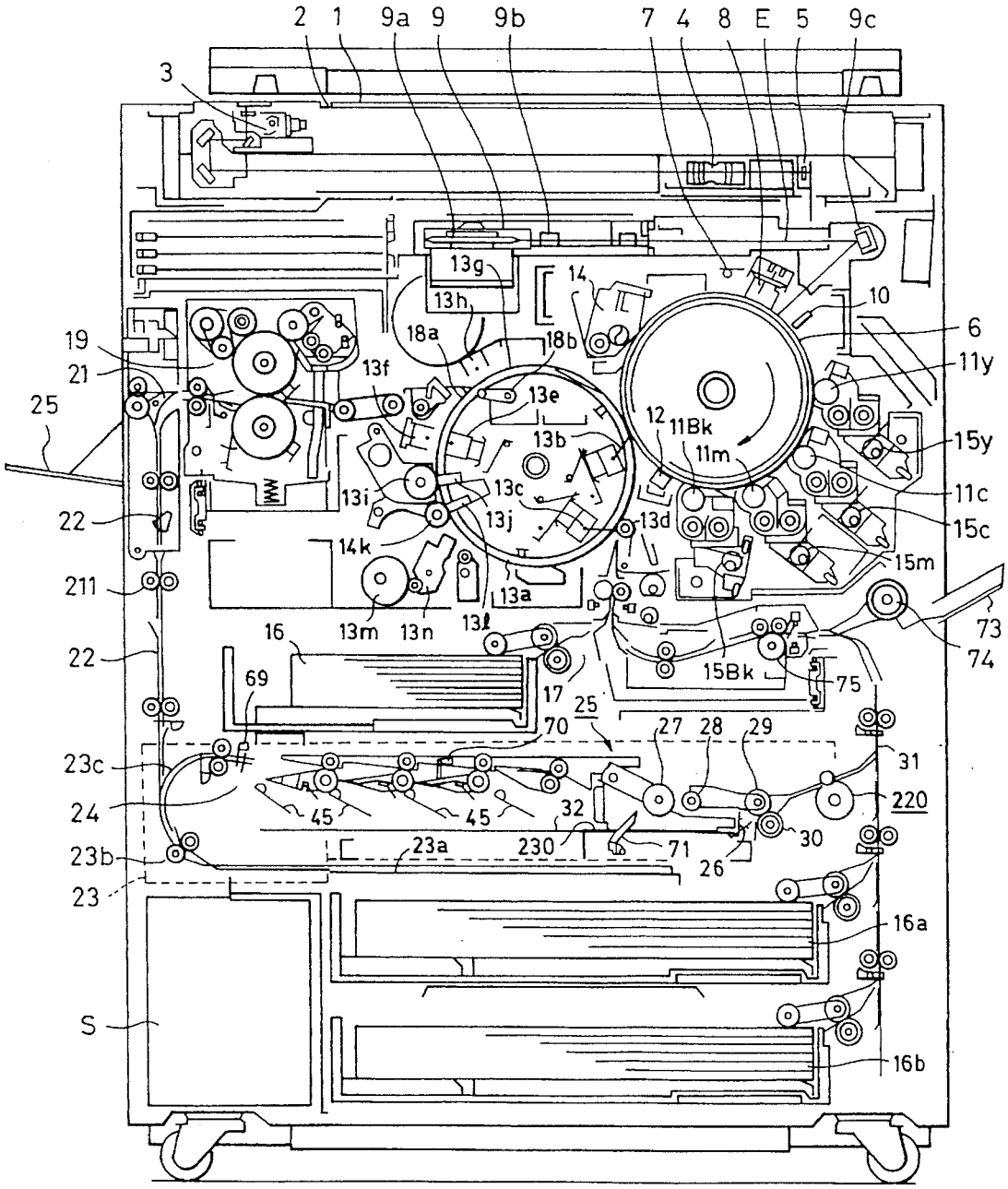
FIG. 19 is a schematic view showing the structure of the color copying machine.
Figure 20:
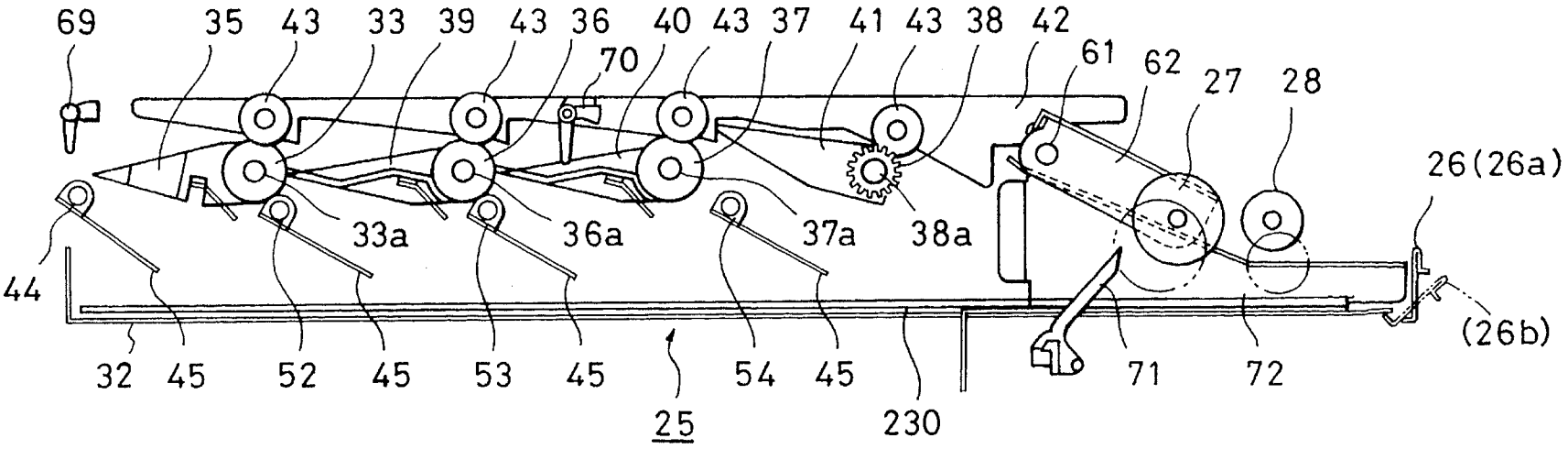
FIG. 20 is a cross sectional view showing the intermediate tray.
Figure 21:
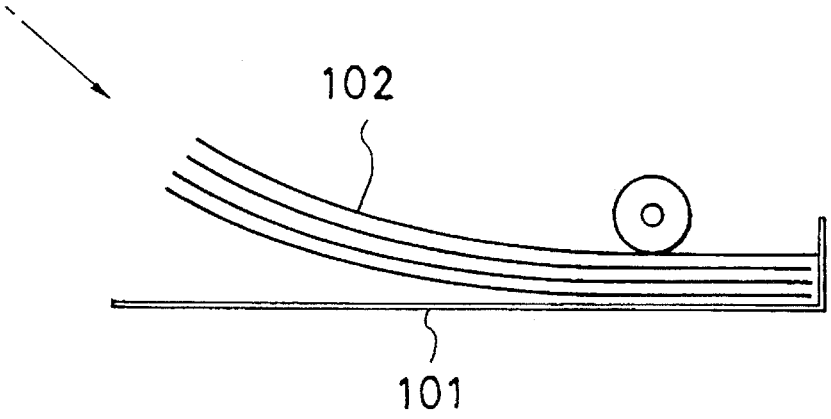
FIG. 21 is a diagram showing a problem experienced with the conventional intermediate tray.
Figure 22:
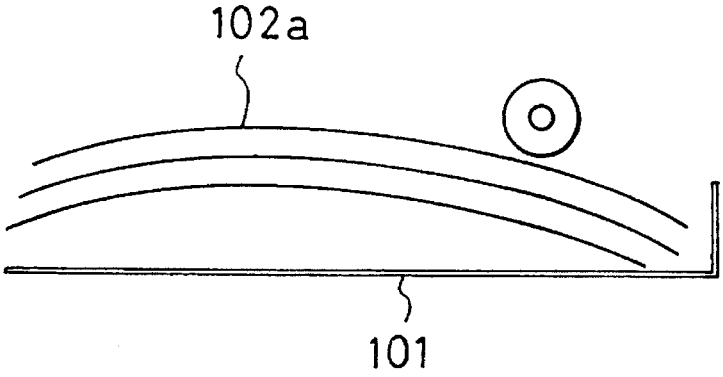
FIG. 22 is a diagram showing a possible solution to the problem experienced in the arrangement of FIG. 21.

A sixth embodiment of an electromagnetic of the image forming apparatus according to the present invention using the foregoing means will now be described with reference to the drawings. In this embodiment, the image forming apparatus is a color copying machine capable of recording data on the two sides of sheets. FIG. 18 is a schematic view showing the color copying machine, FIG. 19 is a diagram showing the schematic structure of the color copying machine, and FIG. 20 is a cross sectional view of an intermediate tray.

The elements according to the sixth embodiment that are the same as those of the first embodiment are given the same reference numerals and they are omitted from description.

Referring to FIG. 18, a usual conveyance roller pair 211 is provided in place of the curl forming roller 76 for the vertical path 22. A curl forming roller pair 220 serving as a curl forming means is disposed downstream from the retard roller pair 29 and 30 for separating the sheet conveyed from the intermediate tray 25 by the pickup roller 27 and in front of the paper supply path 31. The curl forming roller pair 220 curls the sheet P prior to forming an image on the second side of the sheet P in a direction (curled to the right in FIG. 18) in which the sheet P can easily be carried by the transferring drum 13*a*. The curl forming roller pair 220 comprises a large-diameter sponge roller 220*a* (made of foam urethane) and a small-diameter and hard (made of metal or metal roller coated with resin) roller 220*b* for pressing the sponge roller 220*a*. The sponge roller 220*a* is deformed to cause the sheet P to be wound around the hard roller 220*b*. Thus, the sheet P is curled to the right. Since the direction of the formed curl opposes the direction of curl formed after an image has been fixed, the sheet P, which has passed through the curl forming roller 220, can stably be conveyed.

A heater 230 serving as a temperature adjustment means is provided on the surface of the intermediate tray 25 on which the sheets P are stacked. The heater 230 heats the sheets P stacked on the intermediate tray 25 so as to soften the toner on the sheets P. Thus, curl formed due to the toner can be prevented.

The flow of the sheet P in the thus-constituted color copying machine when images are formed on the two sides of the sheets P and a state in which curl is formed will now be described with reference to FIG. 18. Referring to FIG. 18, the sheets P supplied onto the manual feeding tray 73 are separated and supplied by the supply roller 74 and the paper supply pad 74*a* so that only the uppermost one of the sheets P is supplied. The sheet P is, at this time, supplied in a flat state as indicated in (1).

Then, diagonal movement of third sheet P is corrected by the curl forming roller 75 so that the sheet P is upwardly curled as indicated in (2) when the sheet P passes through the curl forming roller 75.

When the sheet P passes between the photosensitive drum 6 and the transferring drum 13*a*, a toner image is transferred to the sheet P. In a case where a color image is formed, the sheet P is wound around the transferring drum 13*a* and electrostatically carried by the same, followed by performing transference operations plural times (in usual four times). Since the sheet P is previously curled by the curl forming roller 75 so as to easily be wound around the transferring drum 13*a*, the sheet P can smoothly be carried. When an image is transferred to the sheet P, the sheet P is curled upwards as indicated in (3).

After the image transference, the sheet P is conveyed to the heat-fixing roller unit 19 so that heat and pressure are applied to the sheet P when it passes between the fixing roller 19*a* and the pressing roller 19*b*. Thus, an image is fixed. At this time, the sheet P upwards curled as indicated in (3) is somewhat corrected so that the amount of curl is reduced or the sheet P is straightened in a case where toner is uniformly placed on the sheet P. If no toner is placed on the sheet P, heat supplied from the fixing roller 19*a* is dominant and upward curl is formed as indicated in (4).

The sheet P is, after the image has been fixed, guided by the vertical path 22 so as to be introduced into the reversing unit 23 before the sheet P is guided by the reversing path 23*a*. The sheet P is switched back by the reversing roller 23*b* so that the front end and the rear end of the sheet P are inverted at the time of the conveyance. Then, the sheet P is allowed to pass through the side path 23*c* so as to be discharged and stacked in the intermediate tray 25 by the reverse discharge roller 24 in such a manner that the first sides, on which images have been formed, face upwards. At this time, the sheet P is upwards curled as indicated in (5). As a matter of course, downward curl is sometimes formed depending upon the quantity of the toner. The foregoing heater 110 reduces the degree of the curl. The curl is formed in a direction in which the sheet P can easily be wound around the transferring drum 13*a* when an image is formed on the second side of the sheet P.

Sheets P are stacked on the intermediate tray 25 in the following manner: a predetermined flapper is rotated in a state where the sweeping roller 27 and the pickup roller 28 are moved upwards so that the sheet P is introduced into the sheet stacking portion 32; the sweeping roller 27 and the pickup roller 28 are brought into contact with the sheet P to convey the sheet P until the leading portion of the sheet P comes in contact with the gate 26; and then the elastic sheet 45 is rotated once to press the front end and rear end of the uppermost one of the sheets P. As a result, even if a sheet P to be discharged next is warped upwards at the rear end thereof, undesirable introduction of the next sheet P into two previous sheets P causing disorder to be prevented and the sheets P can be smoothly stacked.

The only uppermost one of the sheets P aligned and stacked in the sheet stacking portion 32 by the pickup roller 28 and the retard roller pair 29 and 30 in order to form images on the second sides thereof is separated and supplied to pass through the paper supply path 31 to be conveyed to the curl forming roller 220. When the sheet P passes through the curl forming roller 220, the sheet P is curled in a direction in which the sheet P can easily be wound around the transferring drum 13*a* as indicated in (6). The curl is formed in the opposite direction when viewed from the sheet P because the side is inverted with respect to the first side. However, the sheet P is curled in the same direction as that of the curl forming roller 75 to easily wind the sheet P around the transferring drum 13*a*. After image have been formed on the two sides of the sheet P, the conveyance-path switching guide 21 is switched to discharge and stack the sheets P on the discharge tray 20 in such a manner that the sides of the sheets P face downwards. At this time, the sheet P is sufficiently drawn in the transferring portion and the fixing portion in such a manner that the two sides are inverted and the sheets P are inverted longitudinally. Therefore, the sheets P to be stacked on the discharge tray 20 are stacked flat because the degree of curl is reduced as compared with the curl indicated in (4) in a case where no toner is placed onto the sheets P. When the sheet P passed through the curl forming roller pair 220, the sponge roller 220*a* is deformed to cause the sheet P to be easily wound around the hard roller 220. Therefore, the sheet P is curled downwards to oppose the direction in which the sheet P has been curled as indicated in (6).

The sheet P can be curled very effectively in a state where the sheet P has been heated and the toner has been softened. In order to further improve the efficiency, it is preferable to make the surface of the roller pair with a heat insulating material to prevent deriving of heat of the sheet P by the curl forming roller pair. Specifically, it is effective that the hard roller is applied with resin coating or coated with a resin tube.

As a result of the foregoing structure, when images are formed on the second sides of the sheets P during the process of forming images on the two sides of the sheets P, the sheet P is curled in a direction in which the sheet P can easily be wound around the transferring drum 13*a*. Therefore, the sheets P can be carried stably.

Symbol S represents an electric unit, such as a low-voltage power source, which is capable of rapidly raising the temperature. The heat of the low-voltage power source S heats air which moves upwards to heat the reversing unit 23 and the intermediate tray 25. As a result, the degree of curl formed due to the presence of the toner is reduced and the sheet P can be conveyed stably.

As a result, even if the overall body of the apparatus has been cooled, for example, in early morning, the apparatus can be rapidly heated after the power has been supplied. When the copying operation starts, the portion above the low-voltage power source S has been heated and therefore the reversing path and the intermediate tray 25 can be heated. Thus, the degree of curl formed due to the presence of the toner can effectively be reduced.

The paper feeding cassettes 16, 16*a* and 16*b* supply thin paper sheets of about 100 g/m$^2$ or thinner, while the manual paper feeding portion 73 is able to supply thick paper and films. Since thick paper cannot be smoothly wound around the transferring drum if no curl is formed, it is curled by the curl forming roller 75. In a case of thin paper, in particular, in a case of short paper, the quantity of upward looseness is reduced. Therefore, curl is not required and the paper supply path in the paper supply portion 16 for only half-size paper is provided with no curl forming roller. As a result of experiments, the curl forming roller 75 is suitable to curl thick paper. It can be considered that the reason for this is that the fiber of the paper can easily be deflected by causing the thick paper to move along the roller 75*a*. The curl forming operation using a drawing roller is suitable to curl thin paper. The reason for this is that the fiber cannot easily be deflected and therefore the curl must be formed while drawing the paper.

As a matter of course, any paper can be curled by appropriately determining the quantity of drawing and the degree of winding around the roller.

As described above, according to this embodiment, an image formed on a sheet is fixed; the sheet is reversed to be stacked on the intermediate tray; the sheet is curled in a direction, in which the sheet can easily be carried by the transferring drum (the sheet carrier), prior to forming an image on the second side of the sheet; and the sheet is introduced into a path, through which the sheet passes through when the image for the first side is formed, to form an image for the second side. Therefore, the second side of the sheet can be curled more strongly so that the sheet can stably be carried.

Since the intermediate tray has the temperature-raising means, the toner caused to adhere to the first side can be softened when an image for the first side is formed. Therefore, curl can be effectively formed.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. An image forming apparatus comprising:

sheet carrying means for carrying a sheet;

image forming means for forming an image on the sheet carried by said sheet carrying means;

re-supply means for again supplying the sheet, on which the image has been formed by said image forming means, to said sheet carrying means; and first curl forming means for curling the sheet, which is being again supplied by said re-supply means, in a direction in which the sheet can easily be carried by said sheet carrying means, wherein said sheet carrying means has an outer peripheral surface around which the sheet is wound and carries the sheet by rotating.

2. An image forming apparatus according to claim 1 further comprising a plurality of conveyance paths for guiding the sheet to said sheet carrying means and at least one of the plural conveyance paths is provided with second curl forming means for curling the sheet in a direction in which the sheet can easily be carried by said sheet carrying means.

3. An image forming apparatus according to claim 2, wherein said conveyance path provided with said second curl forming means has a structure enabling the sheet to be inserted manually.

4. An image forming apparatus according to claim 1, wherein said re-supply means has an intermediate tray on which sheets are stacked, and said first curl forming means is disposed upstream from said intermediate tray.

5. An image forming apparatus according to claim 1, wherein said re-supply means has an intermediate tray on which sheets are stacked, and said first curl forming means is disposed downstream from said intermediate tray.

6. An image forming apparatus according to claim 1, wherein said re-supply means has an intermediate tray on which sheets are stacked and comprises temperature adjustment means for adjusting the temperature of sheets stacked on said intermediate tray.

7. An image forming apparatus according to claim 1, wherein the surface of said first curl forming means that comes in contact with the sheet is made of a heat insulating material.

8. An image forming apparatus according to claim 1, wherein said first curl forming means has a pair of rollers for carrying the sheet and either side of each of the rollers is more flexible than another side.

9. An image forming apparatus according to claim 1, wherein said first curl forming means has a first roller and means for guiding the sheet to be wound around said first roller.

10. An image forming apparatus according to claim 9 further comprising a plurality of rollers for guiding to wind the sheet around said first roller.

11. An image forming apparatus in which sheets supplied from sheet accommodating means are carried by a sheet carrier to form and fix images on first sides of the sheets and then the sheets are stacked in intermediate stacking means, and the sheets are again supplied so that images are formed on second sides of the sheets, said image forming apparatus comprising:

first curl forming means disposed between the image fixing means for fixing an image formed on the sheet and the intermediate stacking means, said first curl forming means curling the sheet prior to forming an image for the second side of the sheet in a direction in which the sheet can easily be wound around the sheet carrier; and pressing means for pressing the sheet at the time of discharging and stacking the sheets on said intermediate stacking means, said pressing means pressing the sheet in a direction in which curl of the sheet formed by said first curl forming means is corrected.

12. An image forming apparatus according to claim 11 further comprising second curl forming means for curling the sheet prior to forming an image for the first side of the sheet, said second curl forming means curling the sheet in a direction in which the sheet can easily be carried by said sheet carrier.

13. An image forming apparatus according to claim 11, wherein said intermediate stacking means is disposed above said sheet accommodating means, an electric unit capable of raising the temperature is disposed below said first curl forming means at a position opposing the sheet feeding side of said sheet accommodating means, and said first curl forming means is heated with heat of said electric unit.

14. An image forming apparatus having sheet stacking means on which sheets, on which images have been formed on a first side, are temporarily stacked to again supply the sheets in said sheet stacking means so as to form images on a second side of the sheets, said image forming apparatus comprising:

a pressing member for pressing at least the rear ends of the sheets in said sheet stacking means.

15. An image forming apparatus according to claim 14, wherein a plurality of said pressing members are disposed on said sheet stacking means.

16. An image forming apparatus according to claim 14 or 15, wherein said pressing member is made of an elastic material.

17. An image forming apparatus according to any one of claims 14, 15 or 16, wherein said sheet stacking means is provided with temperature adjustment means.

18. An image forming apparatus according to claim 17, wherein said temperature adjustment means is disposed on the bottom surface of said sheet stacking means.

19. An image forming apparatus comprising:

sheet carrying means for carrying a sheet in such a manner that the sheet is wound around the peripheral surface of the carrying means; image forming means for forming an image on the sheet carried by said sheet carrying means;

storing means for storing the sheet;

a conveyance path for conveying the sheet from said storing means to said sheet carrying means;

re-supply means for sending the sheet on which the image is formed by said image forming means to said conveyance path to supply it again to said sheet carrying means;

first curl forming means for curling the sheet which is being again supplied by said re-supply means in a direction in which the sheet can easily wind around said sheet carrying means.

20. An apparatus according to claim 19, wherein said re-supply means comprises an intermediate tray on which sheets are stacked, and said first curl forming means is disposed upstream from said intermediate tray.

21. An apparatus according to claim 20, wherein said first curl forming means forms a curl in the sheet such that an end of the sheet rises when the sheet is stacked in said intermediate tray.

22. An apparatus according to claim 21, further comprising a pressing member for pressing the end of the sheets stacked in said intermediate tray.

23. An apparatus according to claim 19, further comprising a second curl forming means for forming a curl of the sheet guided by said conveyance path in a direction in which the sheet can easily wind around said sheet carrying means.

24. An apparatus according to claim 23, wherein the sheet guided by said re-supply means is given a further curl by said second curl forming means.

* * * * *

UNITED STATES PATENT AND TRADEMARK OFFICE

CERTIFICATE OF CORRECTION

PATENT NO. : 5,572,308

DATED : November 5, 1996

INVENTOR(S) : Suda et al.

It is certified that error appears in the above-indentified patent and that said Letters Patent is hereby corrected as shown below:

COLUMN 1:

Line 30, "type," should read --type--.
Line 62, "type," should read --type--.

COLUMN 4:

Line 41, "tray; and" should read --tray.--.
Line 43, "tray." should read --tray; and--.

COLUMN 9:

Line 30, "roller 76" should read --roller 76a--.

COLUMN 13:

Line 40, "unit)" should read --unit")--.

COLUMN 14:

Line 40, "turned" should read --be turned--.
Line 61, "shaft 152," should read --shafts 152,--.

COLUMN 16:

Line 28, "approach" should read --to approach--.

COLUMN 17:

Line 17, "gears 64," should read --gears 164,--.

UNITED STATES PATENT AND TRADEMARK OFFICE

CERTIFICATE OF CORRECTION

PATENT NO. : 5,572,308

DATED : November 5, 1996

INVENTOR(S) : Suda et al.

It is certified that error appears in the above-indentified patent and that said Letters Patent is hereby corrected as shown below:

COLUMN 20:

Line 25, "image" should read --images--.
Line 35, "passed" should read --passes--.

COLUMN 21:

Line 31, delete "through".

COLUMN 23:

Line 21, "means; image" should read --means; ¶ image--.

Signed and Sealed this

Fifteenth Day of April, 1997

Bruce Lehman

*Attest:*

BRUCE LEHMAN

*Attesting Officer*

*Commissioner of Patents and Trademarks*